US010793996B2

(12) United States Patent
Seo et al.

(10) Patent No.: US 10,793,996 B2
(45) **Date of Patent: *Oct. 6, 2020**

(54) DRYER AND METHOD OF CONTROLLING THE SAME

(71) Applicant: LG ELECTRONICS INC., Seoul (KR)

(72) Inventors: Ilman Seo, Seoul (KR); Deokjoon Jeong, Seoul (KR); Minho Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/207,909

(22) Filed: Dec. 3, 2018

(65) Prior Publication Data

US 2019/0169783 A1 Jun. 6, 2019

(30) Foreign Application Priority Data

Dec. 1, 2017 (KR) ..... 10-2017-0164469
Nov. 29, 2018 (KR) ..... 10-2018-0151379

(51) Int. Cl.
*D06F 58/30* (2020.01)
*D06F 103/00* (2020.01)
(Continued)

(52) U.S. Cl.
CPC ..... *D06F 58/30* (2020.02); *D06F 2103/00* (2020.02); *D06F 2103/02* (2020.02);
(Continued)

(58) Field of Classification Search
CPC .. D06F 58/28; D06F 58/08; D06F 2058/2861; D06F 2058/2877; D06F 2058/2816
(Continued)

(56) References Cited

U.S. PATENT DOCUMENTS 4,086,707 A * 5/1978 Bochan ..... D06F 58/02 192/82 T
5,281,956 A * 1/1994 Bashark ..... D06F 37/304 340/12.32
(Continued)

FOREIGN PATENT DOCUMENTS

EP 2009169 12/2008
EP 2719813 4/2014
(Continued)

OTHER PUBLICATIONS

Extended European Search Report in European Application No. 18209719.6, dated Mar. 27, 2019, 10 pages.

*Primary Examiner* — Stephen M Gravini
(74) *Attorney, Agent, or Firm* — Fish & Richardson P.C.

(57) ABSTRACT

Disclosed are a dryer and a method of controlling the same, the dryer which is capable of: quickly and accurately determining an amount of laundry loaded in the dryer and controlling a drying operation according to the amount of the laundry: measuring a current supplied to rotate the drum and extracting a force applied to laundry in the drum to measure an amount of the laundry, thereby minimizing an error in the amount of laundry and thus enhancing accuracy of the measurement and improving a drying time; setting a drying time in consideration of both a calculated amount of laundry and a type of the laundry, such that damage to the laundry is prevented and over-drying or less-drying of the laundry is solved, thereby efficiently drying the laundry.

20 Claims, 16 Drawing Sheets

(51) Int. Cl.
*D06F 103/02* (2020.01)
*D06F 103/34* (2020.01)
*D06F 103/44* (2020.01)
*D06F 105/46* (2020.01)

(52) U.S. Cl.
CPC ..... *D06F 2103/34* (2020.02); *D06F 2103/44* (2020.02); *D06F 2105/46* (2020.02)

(58) Field of Classification Search
USPC ..... 34/526, 595–610
See application file for complete search history.

(56) References Cited

U.S. PATENT DOCUMENTS

| | | | | |
|---|---|---|---|---|
| 8,104,191 | B2 * | 1/2012 | Ricklefs | D06F 58/203 34/474 |
| 8,256,139 | B2 * | 9/2012 | Morrison | D06F 58/28 34/413 |
| 8,276,293 | B2 * | 10/2012 | Ricklefs | D06F 58/203 34/595 |
| 8,974,546 | B2 * | 3/2015 | Ghosh | D06F 35/00 252/8.61 |
| 9,255,359 | B2 * | 2/2016 | Altinier | D06F 58/28 |
| 10,100,460 | B2 * | 10/2018 | Bisaro | D06F 58/28 |
| 10,294,605 | B2 * | 5/2019 | Cavarretta | D06F 58/28 |
| 2005/0016013 | A1 * | 1/2005 | Bang | D06F 58/08 34/486 |
| 2005/0188471 | A1 * | 9/2005 | Ahn | D06F 25/00 8/158 |
| 2019/0048513 | A1 * | 2/2019 | Jang | D06F 35/00 |
| 2019/0153658 | A1 * | 5/2019 | Je | D06F 25/00 |
| 2019/0169783 | A1 * | 6/2019 | Seo | D06F 58/28 |
| 2019/0169784 | A1 * | 6/2019 | Seo | D06F 58/28 |
| 2019/0169785 | A1 * | 6/2019 | Seo | D06F 58/28 |
| 2019/0301071 | A1 * | 10/2019 | Altinier | D06F 29/005 |

FOREIGN PATENT DOCUMENTS

| | | | | |
|---|---|---|---|---|
| EP | 2927364 | | 10/2015 | |
| EP | 3492648 | A1 * | 6/2019 | D06F 58/28 |
| KR | 1019980009628 | | 4/1998 | |
| KR | 1020100096387 | | 9/2010 | |
| KR | 1020140045714 | | 4/2014 | |
| KR | 1020150019647 | | 2/2015 | |
| KR | 101711827 | | 3/2017 | |
| WO | WO-2019108005 | A1 * | 6/2019 | D06F 58/28 |

* cited by examiner (b)

(a)

(a)

(b)

(a)

(b)

(a)

(b)

DRYER AND METHOD OF CONTROLLING THE SAME

CROSS-REFERENCE TO RELATED APPLICATION

This application claims the priority benefit of Korean Patent Application No. 10-2017-0164469, filed on Dec. 1, 2017, and 10-2018-0151379, filed on Nov. 29, 2018 in the Korean Intellectual Property Office, the disclosures of which are incorporated herein by reference.

BACKGROUND

1. Field

The present disclosure relates to a clothes dryer and a method of controlling the same.

2. Description of the Related Art

In general, a laundry treatment apparatus is an apparatus for treating laundry through various operations such as cleaning, dehydrating, and/or drying operations, and generally refers to a washing machine, a dehydrator, and a dryer.

The dryer is an apparatus which, while rotating a drum, blowing heated air to the inside of the drum with wet laundry loaded therein so as to dry the laundry.

According to how to process humid air discharged from the drum after drying of clothes, the dryer may be classified into an exhaust-type dryer and a condensing-type dryer. In addition, with a heat pump, the dryer reduces energy consumption using thermal energy discharged in an exhaust or condensing process.

Such a dryer dries laundry using heated air, so the dryer is configured to set a drying time according to a type of the laundry, rather than an amount of the laundry, such that the laundry is dried for a predetermined time period.

An operation mode is set by distinguishing laundry sensitive to heat and laundry not sensitive to heat, such that the laundry sensitive to heat is dried for a short time period in order to prevent damage to the laundry by the heat whereas the laundry not sensitive to heat is dried for a relatively long time period, thereby completely being dried.

In addition, Japanese Patent Application Publication No. 2007-108870 adapts a technique of changing a drying time based on temperature, rather than an amount of laundry.

The dryer has a drum that constantly rotates at a preset rotation speed, and, when the dryer operates for a preset time period with the same laundry, a dry state of laundry may differ according to an amount of the laundry. In addition, if temperature increases, it may increase a drying speed but this may lead to damage of the laundry, and therefore, there is a limitation in increasing the temperature.

In addition, if the drying time increases, the drying operation cannot be terminated at an initially set timing, thereby increasing user inconvenience.

U.S. Pat. No. 1,414,624 discloses accurately calculating a remaining time by sensing an amount of laundry, and displaying the remaining time in order to solve the problem that a user can misunderstand a drying time when the drying time is reset during a drying operation.

To this end, sensing an amount of laundry is described, but this description is mainly about displaying a remaining time, and this related art discloses just sensing the amount of laundry, not a detailed method therefor, and thus, it does not proposes a specific method of determining the amount of laundry using a measurement and enhancing accuracy of the determination. In addition, Korean Patent No. 1505189 discloses sensing an amount of laundry using a current flowing in a motor. This disclosure describes a step of accelerating the motor and a step of maintaining the motor at a constant speed, for the purpose of sensing an accurate quantity of laundry, and proposes calculating an amount of laundry using current values in the accelerating step and the maintaining step.

However, there is a limitation in applying this related art to a dryer since the related art is a method applied to a washing machine. In addition, a method of setting an operation time according to an amount of laundry has been applied to existing washing machines.

However, unlike a washing machine, in a dryer, wet laundry is loaded, so there is difference in weight between dry laundry and wet laundry and a rotation speed during a drying operation of the dryer does not change a lot, and the dryer and the washing machine are driven in different ways since the washing machine aims to remove foreign substances using friction and dropping of laundry and the dryer aims to dry laundry, and therefore, there is a limitation in applying a method of the washing machine to the dryer.

In particular, because wet laundry is heavier than dry laundry, a considerable amount of currents is required for initial driving, and an amount of laundry may be measured differently according to an initial position of the laundry and movement of the laundry by driving of a motor. In addition, unlike the washing machine, the dryer dries clothes using heated air and rotation of drum, not in a manner of dehydrating moisture of wet laundry by a centrifugal force, so, when a drum rotates at a high speed, the laundry is dried not in a state of being stuck with the drum, and, when the drum rotates at a low speed, clothes does move enough and thus only some of the clothes are dried.

Wet laundry is easily stuck with a wall surface of a drum compared to dry laundry, and thus, unlike a washing machine rotating along with a drum, a dryer for towing laundry and dropping the laundry to dry the same has a problem that drying performance is significantly degraded when the laundry is stuck with a wall surface of a drum.

Thus, unlike the washing machine, it is necessary to consider rotation of the drum to easily tow wet laundry and drop the laundry.

In addition, there is a problem that a deviation in measured amounts of clothes occurs according to a method of rotating the drum of the dryer and a speed and a time of rotating the drum.

A different problem may happen according to connection between a motor and a drum and a method of rotating the drum, and it is necessary to solve this problem.

In particular, when it comes to applying a pulley-type driving method, a slip between a belt and a drum may occur. The pulley-type method is a method in which the drum in contact with the belt rotates by movement of the belt when the belt connected to the motor moves upon operation of the motor. Since a slip between the belt and the drum occurs when the motor rotates at a high speed, there is a problem that the drum does not rotate a preset number of times of rotation.

In addition, if laundry accommodated in the dryer increases, a driving power as great as an increase in weight of the laundry is required, but, in a method of being towed by a belt, the load increases significantly and thus a slip is more likely to occur.

SUMMARY OF THE DISCLOSURE

The present disclosure provides a dryer and a method of controlling the same, the dryer which is capable of quickly and accurately determining an amount of laundry loaded in the dryer and controlling a drying operation according to the amount of the laundry.

In addition, the present disclosure provides a dryer and a method of controlling the same, the dryer which controls towing and dropping laundry to dry the laundry.

In one general aspect of the present disclosure, there is provided a dryer including: a motor connected to a drum via a drive belt and configured to rotate the drum; a blow fan configured to circulate air, passing through the drum in response to driving of the motor; a driving controller configured to apply operation power to the motor so as to operate or stop the motor, and to control a rotation speed of the motor; a current sensing unit configured to measure a current value of the motor; and a controller configured to apply a control command to the driving controller so as to control the motor such that the drum rotates, and to sense an amount of laundry based on current values sensed by the current sensing unit while the drum rotates, wherein the controller is further configured to, when the amount of the laundry is sensed, perform control such that the rotation speed of the drum increases to a preset target rotation speed, and to control acceleration of the rotation speed of the drum until reaching the target rotation speed.

The controller may be further configured to, in an acceleration stage in which the rotation speed of the drum increases to the target rotation speed, control the acceleration of the rotation speed of the drum according to a resolution and a linearity with respect to the amount of the laundry calculated based on the current values.

The controller may be further configured to control the rotation speed of the drum at an acceleration gradient that is set within a range of 300 rpm/s to 1700 rpm/s.

In another general aspect of the present disclosure, there is provided a dryer including: a motor connected to a drum via a drive belt and configured to rotate the drum; a blow fan configured to circulate air, passing through the drum in response to driving of the motor; a driving controller configured to apply operation power to the motor so as to operate or stop the motor, and to control a rotation speed of the motor; a current sensing unit configured to measure a current value of the motor; and a controller configured to apply a control command to the driving controller so as to control the motor such that the drum rotates, and to sense an amount of laundry based on current values sensed by the current sensing unit while the drum rotates, wherein the controller is further configured to, when the amount of the laundry is sensed, perform control by distinguishing an acceleration stage in which a rotation speed of the drum increases and a maintaining stage in which the rotation speed is maintained, and to perform control such that the rotation speed of the drum increases at an acceleration gradient that is set within a range of 500 rpm/s to 1500 rpm/s in the acceleration stage.

The controller may be further configured to control the rotation speed of the drum at an acceleration gradient that is set within a range of 500 rpm/s to 1000 rpm/s or within a range of 1250 rpm/s or 1500 rpm/s in the acceleration stage.

The controller may be further configured to increase the rotation speed of the drum at an acceleration gradient of 750 rpm/s in the acceleration stage according to a resolution and a linearity with respect to the amount of the laundry.

In yet another general aspect of the present disclosure, there is provided a dryer including: a motor connected to a drum via a drive belt and configured to rotate the drum; a blow fan configured to circulate air, passing through the drum in response to driving of the motor; a driving controller configured to apply operation power to the motor so as to operate or stop the motor, and to control a rotation speed of the motor; a current sensing unit configured to measure a current value of the motor; and a controller configured to apply a control command to the driving controller so as to control the motor such that the drum rotates, and to sense an amount of laundry based on current values sensed by the current sensing unit while the drum rotates, wherein the controller is further configured to: distinguish an acceleration stage in which the rotation speed of the drum increases to a target rotation speed and a maintaining stage in which the target rotation speed is maintained; calculate the amount of the laundry based on current values sensed in the acceleration stage and the maintaining stage; and control the rotation speed of the drum at an acceleration gradient that is set according to a linearity and a resolution, wherein the linearity indicates a change in measurements according to an increase in the amount of the laundry, and the resolution indicates a range of measurements according to the amount of the laundry.

In yet another general aspect of the present disclosure, there is provided a method of controlling a dryer, including: rotating the drum by driving a motor upon loading of laundry; accelerating a rotation speed of the drum to a preset target rotation speed; after the acceleration stage, maintaining the rotation speed of the drum in a maintaining stage; calculating an amount of the laundry by sensing current values measured in the motor while the drum rotates; and performing a drying operation according to the amount of the laundry, wherein, the accelerating of the rotation speed of the drum includes controlling acceleration of the rotation speed of the drum until reading the target rotation speed.

The accelerating of the rotation speed of the drum comprises increasing the rotation speed of the drum at an acceleration gradient that is set within a range of 300 rpm/s to 1700 rpm/s. The method is characterized by including: rotating the drum by driving a motor upon loading of laundry; increasing a rotation speed of the drum in an acceleration stage; after the acceleration stage, maintaining the rotation speed of the drum in a maintaining stage; calculating an amount of the laundry by sensing current values measured in the motor while the drum rotates; and performing a drying operation according to the amount of the laundry, wherein, in the acceleration stage, the rotation speed of the drum increases at an acceleration gradient that is set within a range of 500 rpm/s and 1500 rpm/s.

The method may further include: after the maintaining stage, changing a rotation direction of the drum; and repeating the acceleration stage and the maintaining stage a preset number of times.

The present disclosure is characterized by including: rotating the drum by driving a motor; accelerating a rotation speed of the drum to a preset rotation speed in an acceleration stage; maintaining the target rotation speed in a maintaining stage; calculating an amount of laundry by sensing current values in the motor in the acceleration stage and the maintaining stage while the drum rotates; and performing a drying operation according to the amount of the laundry, wherein, in the acceleration stage, when the amount of the laundry is sensed, an acceleration gradient is set to increase the rotation speed of the drum according to a resolution and a linearity, wherein the resolution indicates a range of measurements according to the amount of the laundry, and the linearity indicates a change in measurements according to an increase in the amount of the laundry.

As such, the dryer and the method of controlling the same have an advantageous effect in that currents supplied to rotate the drum are measured, a force acting on laundry loaded into the dryer is extracted, and thereby an amount of the laundry is calculated, thereby minimizing an error in the amount of the laundry and enhancing accuracy.

The present disclosure may be capable of sensing an amount of wet laundry.

The present disclosure may control a rotation speed to a degree where wet laundry is lifted as moving in accordance with rotation of the drum and dropped.

The present disclosure may control a rotation speed of a drum to adjust movement of laundry, thereby enhancing efficiency of drying the laundry and improving a drying time.

The present disclosure may set an acceleration stage, in which the rotation of the drum increases, to be longer than a maintaining stage, thereby enabled to efficiently transfer a driving force of a motor to the drum.

The present disclosure may address a slip between a belt, connecting the motor and the drum, and the drum. The present disclosure may set a drying time in consideration of both a calculated amount of laundry and a type of the laundry, thereby preventing damage to the laundry.

The present disclosure may solve the problem of over-drying or less-drying laundry, thereby enabled to efficiently dry the laundry.

In addition, the present disclosure change a setting in response to a state of laundry sensed during a drying operation, and operates according to the sensed state of the laundry, and accordingly, the drying operation may be completed within a preset drying time.

The present disclosure may enhance drying efficiency and prevent unnecessary movement of a user because a drying operation is completed within a preset time period, thereby enhancing convenience and improving product reliability significantly.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Advantages and features of the present disclosure and a method of achieving the same will be clearly understood from embodiments described below in detail with reference to the accompanying drawings. However, the present disclosure is not limited to the following embodiments and may be implemented in various different forms, and the embodiments are provided merely for complete disclosure of the present disclosure and to fully convey the scope of the disclosure to those of ordinary skill in the art to which the present disclosure pertains, and the embodiments are provided merely for complete disclosure of the present disclosure and to fully convey the scope of the disclosure to those of ordinary skill in the art to which the present disclosure pertains. A controller and any other component included in the present disclosure may be implemented by one or more micro processors and may be implemented by a hardware device.

Figure 1:
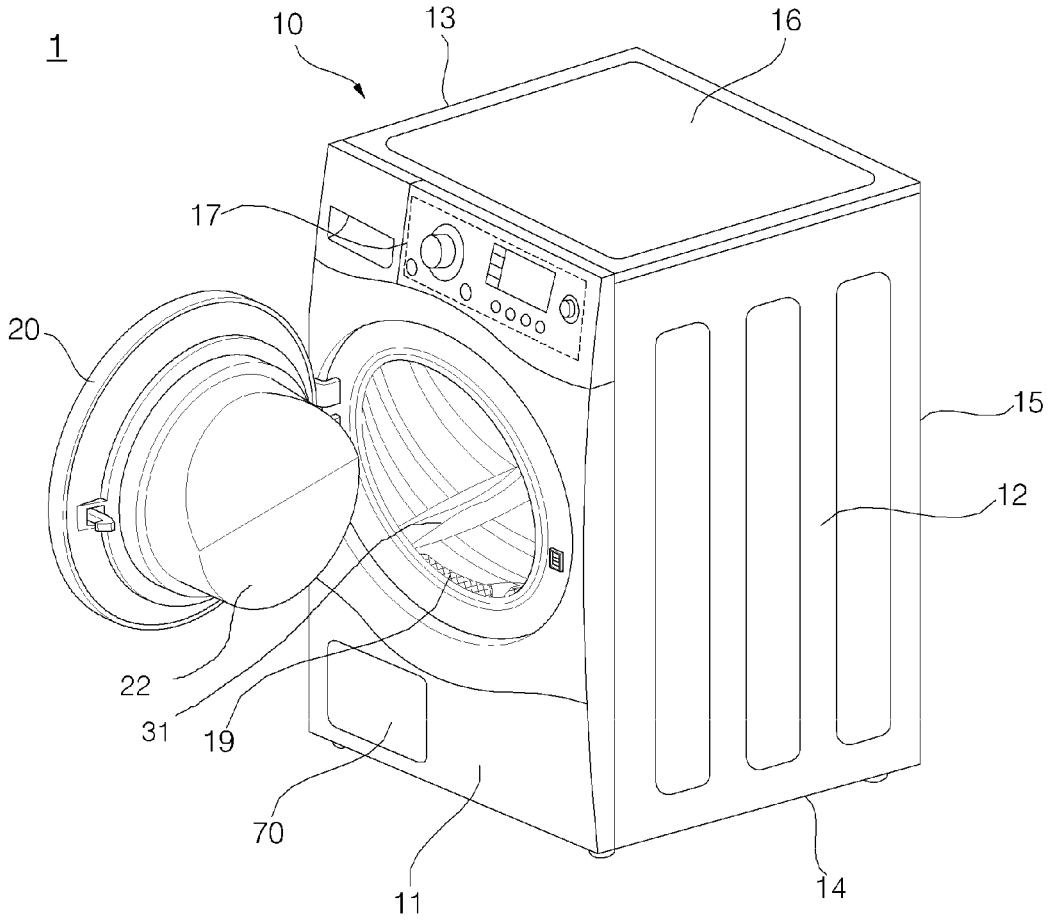
FIG. 1 is a perspective view of a dryer according to an embodiment of the present disclosure.
Figure 2:
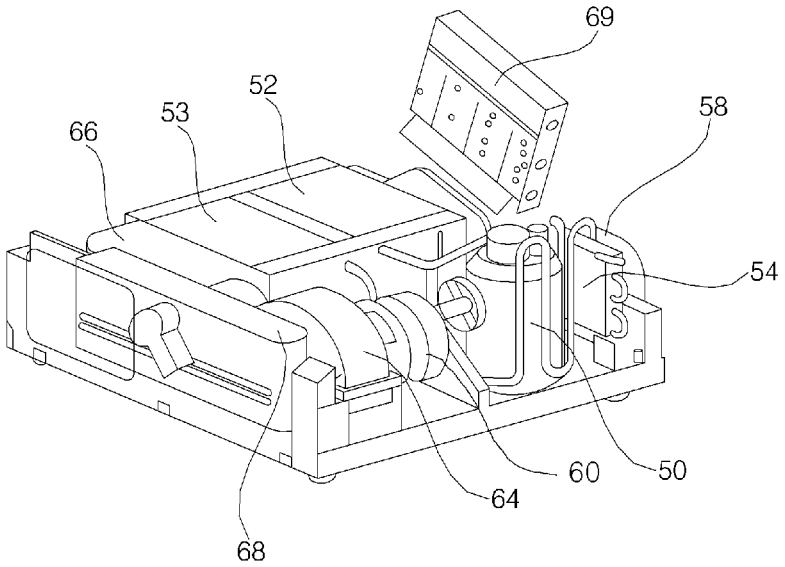
FIG. 2 is a perspective view illustrating the interior of the dryer of FIG. 1.

FIG. 1 is a perspective view of a dryer according to an embodiment of the present disclosure. FIG. 2 is a perspective view illustrating the interior of the dryer of FIG. 1, and FIG. 3 is a diagram for explanation of air circulation in the dryer of FIG. 1.

Figure 3:
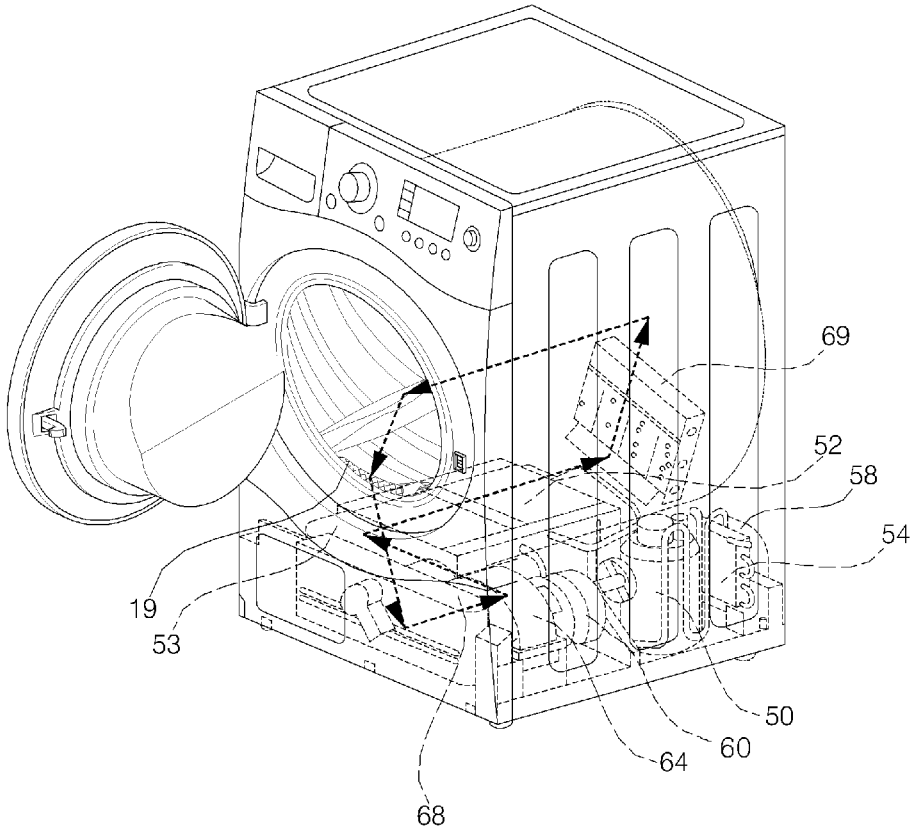
FIG. 3 is a diagram for explanation of air circulation in the dryer of FIG. 1.

A driver 1 of the present disclosure is configured as illustrated in FIGS. 1, 2, and 3.

The dryer 1 according to the present disclosure includes: a cabinet 10, a drum 30 disposed in the cabinet and rotating with a laundry loaded therein; a driver 60 for rotating the drum 30, a heat pump module 50, 52, 53, 54, and 58 for heating air circulating in the drum 30 and to thereby the laundry; a blow fan 64 for circulating air in the drum 30; a heater 69 for heating air being introduced into the drum 30; and a circulation flow path 66 for guiding an airflow.

The cabinet 10 defines the exterior of the dryer, and provides a space in which the drum 30 and any other components are arranged. The cabinet 10 is formed in an entire rectangular shape.

A door 20 is disposed on the front surface of the cabinet 10, and the door 20 is rotated to the left and to the right so as to open and close the inside of the cabinet 10.

The cabinet 10 includes a front cover 11, a top plate 16, side covers 12 and 13, a rear cover 15, and a base 14.

An entry hole (not shown) is formed in the front cover 11, and the door 20 for opening and closing the entry hole. The entry hole communicates with the drum 30.

The door 20 may be rotatably coupled to the front cover 11 and include a door glass 22. The door glass 22 is formed of a transparent member so as to allow a user to see the inside of the drum 30, and has a shape convex toward the inside of the drum 20.

A control panel 17 may be disposed above the front cover 11. The control panel 17 includes: a display (e.g., an LCD, an LED panel, etc.) for displaying information about the state of operation of the dryer; an manipulation unit (e.g., a button, a dial, a touch screen, etc.) for receiving a command from a user to operate the dryer; and a speaker (not shown) for outputting a voice guidance about the state of operation, an effect sound, or an alert sound.

The drum 30 is disposed in the inside of the cabinet 10, and the blow fan 64 and the heat pump module are disposed under the drum 30 in order to maximize the capacity of the drum 30.

The drum 30 is formed in a cylindrical shape, and the front surface and the rear surface thereof are opened, wherein the front surface communicates with the entry hole. In addition, an air inlet (not shown) is formed on the rear surface of the drum 30 so that air is introduced, and the air inlet is connected to the circulation flow path for circulating air.

A lifter 31 is installed in the inside of the drum 30, and the lifter 31 lifts up laundry within the drum while rotating and then lets the laundry freely fall. The drum is supported by a supporter (not shown) provided in the cabinet.

The driver 60 includes a motor fixed to a base 14 of the cabinet 10. The motor provides power for rotating the drum, and is also connected to the blow fan 64, thereby rotating the blow fan. The motor is a motor having double shafts to which the drum 30 and the blow fan 64 are connected, respectively.

The motor includes a drive pulley, which is engaged with a drive belt 164 wound around the drum 30, on the shaft connected to the drum. The drum 30 may rotate forward or backward by the rotation of the motor. An idle pulley (not shown) may be installed to adjust tension of the drive belt. The drive belt may surround the circumferential surface of the drum, while engaged with the drive pulley and the idle pulley. When the motor rotates, the drive belt is transferred by the drive pulley and the drum 30 rotates by a friction force applied between the drum and the drive belt.

The blow fan 64 may rotates by the motor of the driver 60. By the rotation of the blow fan 64, air in the drum 30 is introduced into a suction duct 68. The suction duct 68 may be included in the circulation flow path 66.

When the blow fan 64 rotates, air discharged from the drum 30 is guided to the suction duct 68 and the supplied to the blow fan 64. The suction duct 68 is coupled to the front surface of a front supporter, and communicates with an air inlet of the blow fan 64. The blow fan 64 circulates air in a manner in which air suctioned from the drum passes through the heat pump module through the circulation flow path 66 and then flows back to the drum.

When the drum 30 rotates forward, air flows from the back of the drum to the inside of the drum and air is discharged to the front of the drum. In addition, when the drum rotates backward, air may flows from the front of the drum and discharged to the back of the drum.

The circulation flow path 66 may be configured in various ways according to an embodiment. The circulation flow path 66 guides air, discharged from the blow fan, to the heat pump module and also guides air, discharged from the heat pump module, to the drum through the heater. The circulation flow path 66 may be provided even at the back of the drum so that heated air flows into the drum 30.

The circulation flow path along which air within the drum circulates may be formed in various ways. The circulation flow path 66 may be connected to the drum, thereby forming a closed loop for air circulation. In addition, the circulation flow path may be connected to a discharge duct (not shown) through which air is discharged, and a suction duct (not shown) through which outdoor air is introduced.

A filter assembly 19 is installed at the entry hole to collect lint included in air, which is discharged from the drum 30 and then flows to the suction duct.

The heat pump module circulates a refrigerant, driving the refrigerant in a heat pump cycle.

Laundry loaded in the drum may be dried by heated air supplied to the drum. Air discharged from the drum flows into the circulation flow path with containing moisture evaporated from the laundry during a drying operation, and the discharged air is heated through the heat pump module and then supplied back to the drum.

The heat pump module includes a compressor 50, a condenser 52, an evaporator 53, and an expansion valve.

The heat pump module is configured such that the compressor 50, the condenser 52, and the evaporator 53 are connected to each other via a refrigerant pipe and thus air heated through heat exchange between a refrigerant and air in the condenser and the evaporator is supplied to the drum through circulation of the refrigerant. In some cases, the heat pump module may enable heat exchange with a medium other than the refrigerant.

By causing heat exchange between air flowing through the blow fan 64 from the drum 30 and a refrigerant, the evaporator 53 may recollect energy of discharged air. In addition, the evaporator 53 condenses moisture contained in the introduced air.

The condenser 52 causes heat exchange between air passing through the evaporator 53 and a refrigerant and discharges heated air to the drum. Air of low temperature and low humidity passing through the evaporator is introduced to the condenser and thermally exchanged with a refrigerant, and then supplied to the drum in a state of high temperature and low humidity.

The refrigerant discharged from the condenser passes through the evaporator and is then recollected in the compressor, the compressor 50 compresses an evaporated refrigerant and discharges the compressed refrigerant to the condenser, and the expansion valve expands the refrigerant condensed in the condenser 52.

The compressor 52 and the evaporator 53 are heat exchangers.

Since hot and humid air discharged from the drum 30 is hotter than a refrigerant of the evaporator 53, the air is thermally exchanged with the refrigerant while passing through the evaporator, thereby being condensed and cooled down. Accordingly, the hot and humid air is dehumidified and cooled down by the evaporator. Condensate generated in the course of condensing the air may be collected in a condensate housing (not shown) and drained.

In addition, the heat pump module may further include an auxiliary heat exchanger 54 and a cooling fan 58. The auxiliary heat exchanger 54 may be configured by a detachable condensing module, which is detachable from the condenser 52. The auxiliary heat exchanger and the cooling fan may be configured as one module or may be detachable from each other.

The auxiliary heat exchanger 54 may be installed in a refrigerant pipe extending from the condenser to the expansion valve with reference to a refrigerant flow direction, and cool down a refrigerant discharged from the condenser.

The cooling fan transfers external or internal air of the cabinet to the auxiliary heat exchanger, thereby cooling down the auxiliary heat exchanger.

Figure 4:
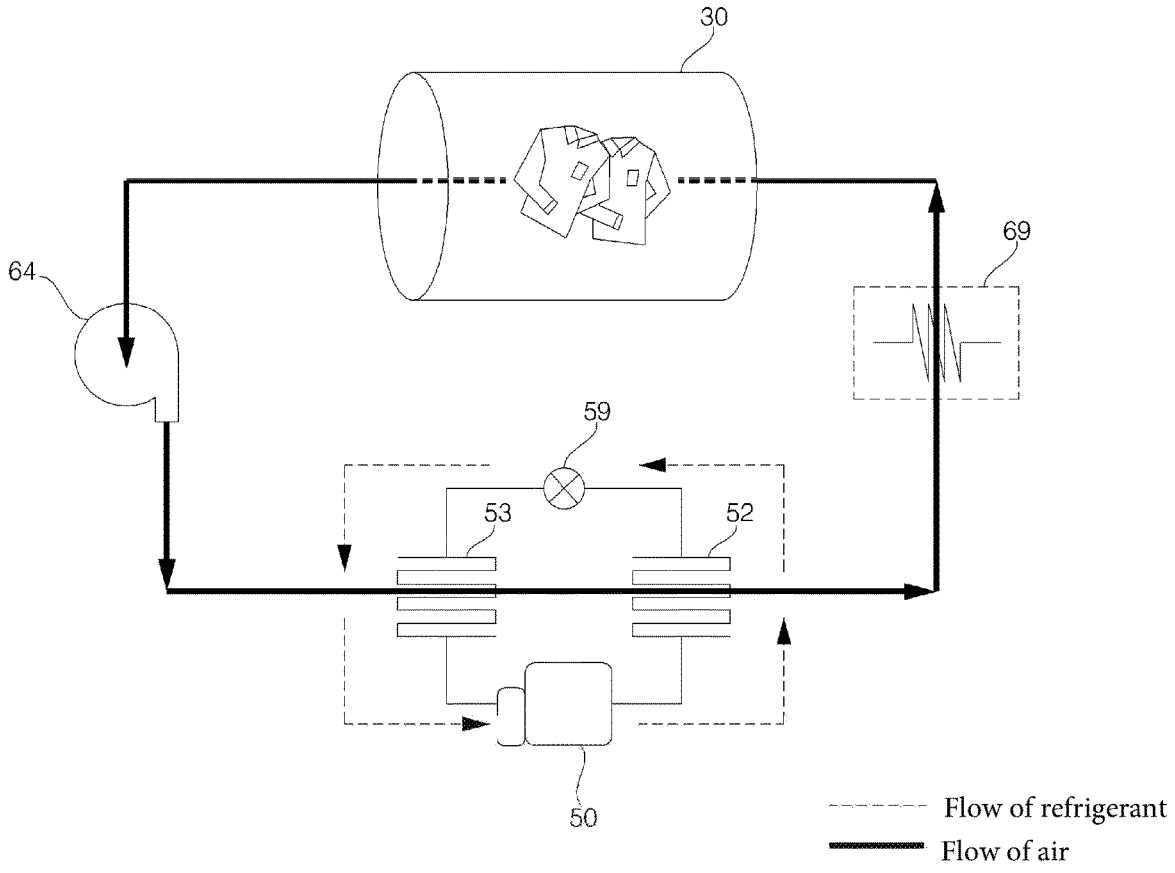
FIG. 4 is a diagram for explanation of air circulation and refrigerant circulation in the dryer of FIG. 1.

FIG. 4 is a diagram for explanation of air circulation and refrigerant circulation in the dryer of FIG. 1. As illustrated in FIG. 4, air supplied to the drum 30 heats up laundry, absorbs moisture evaporated from the laundry, and then discharges the moisture.

The air is circulated by the blow fan 64.

The air flows to the evaporator 53 through the drum by the blow fan, is condensed in the evaporator, and then flows to the condenser 52 in a state of low temperature and low humidity. The air 52 is heated up as a result of heat exchange with a refrigerant of the condenser 52, and then flows back to the drum 30. The air may be additionally heated up by a heater installed on the circulation flow path.

One of the heat pump module and the heater 69 may selectively operate, or the both may operate at the same time.

Air flows in a sequence of the drum 30, the evaporator 53, and the condenser 52.

The refrigerant is discharged by the compressor 50 to the condenser 52 in a state of high temperature and high pressure, thermally exchanged with air in the condenser, and then flows to the evaporator 53, thereby being evaporated. The expansion valve 59 is installed between the condenser and the evaporator. The expansion valve expands a condensed refrigerant of low temperature and high pressure and transfers the expanded refrigerant to the evaporator. The expanded refrigerant is evaporated in the evaporator 53, flows to the compressor 50 in a state of low temperature and low pressure, and is then discharged to the condenser in a state of high temperature and high pressure.

Figure 5:
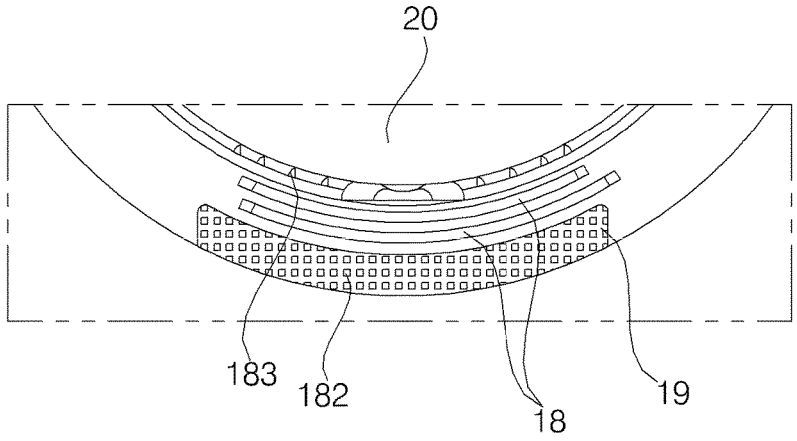
FIG. 5 is a diagram illustrating a structure of a dryer, in which air is recollected from a drum in a flow path and a foreign substance is collected, according to an embodiment of the present disclosure.

FIG. 5 is a diagram illustrating a structure of a dryer, in which air is recollected from a drum in a flow path and a foreign substance is collected, according to an embodiment of the present disclosure.

As illustrated in FIG. 5, a filter assembly 19 is installed in the entry hole toward the drum, especially the front part of the drum where the front panel and the drum are connected. Air discharged from the drum passes through the filter assembly 19, and flows to the evaporator along the circulation flow path through the blow fan.

In the course of flowing to the evaporator 53 from the drum 30 by the blow fan 64, air passing through the drum may be separated from laundry while passing through the filter assembly 19 of the drum, thereby removing lint contained in the air.

The filter assembly 19 may include a filter case 182 fixed to the front supporter, and a lint filter 183 detachable from the filter case 182. The filter case 182 forms an accommodation space in which a lint filter 183 is accommodated, and a filter inserting hole is formed in a top surface of the accommodation space so that the lint filter 183 is insertable into the accommodation space. The lint filter 183 may be inserted into the accommodation space through the filter inserting hole or may be drawn from the accommodation space.

The front surface of the drum includes an electrode 18 of a laundry sensing unit serving to sense a state of laundry in the drum. The laundry sensing unit is composed of two electrode sensors. The two electrode sensors are installed with a predetermined space apart from each other, include a cathode and an anode, and are exposed toward the drum.

As an electrode sensor contacts laundry while the laundry is moving by rotation of the drum, the electrode sensor senses a state of the laundry, especially, an amount of moisture contained in the laundry. A controller (not shown) determines a dry state of the laundry according to the amount of moisture contained in the laundry, sensed by the electrode sensor.

When the laundry is in contact with the electrode sensor, a closed circuit is formed as two polarities are conducted by the moisture contained in the laundry, and a dry degree of clothes may be determined based on the current value as a value of a current flowing in the circuit is varied. The laundry acts as a resistance for the electrode, and a resistance value is varied according to an amount of moisture contained in the laundry, and thus, the current flowing in the circuit is varied as well.

The controller not just obtains the dry degree, but also controls various electronic components of the dryer 1. The controller may include a Central Processing Unit (CPU), and a memory for storing data in a format readable by the CPU. The controller may be one processor or a plurality of processors.

Figure 6:
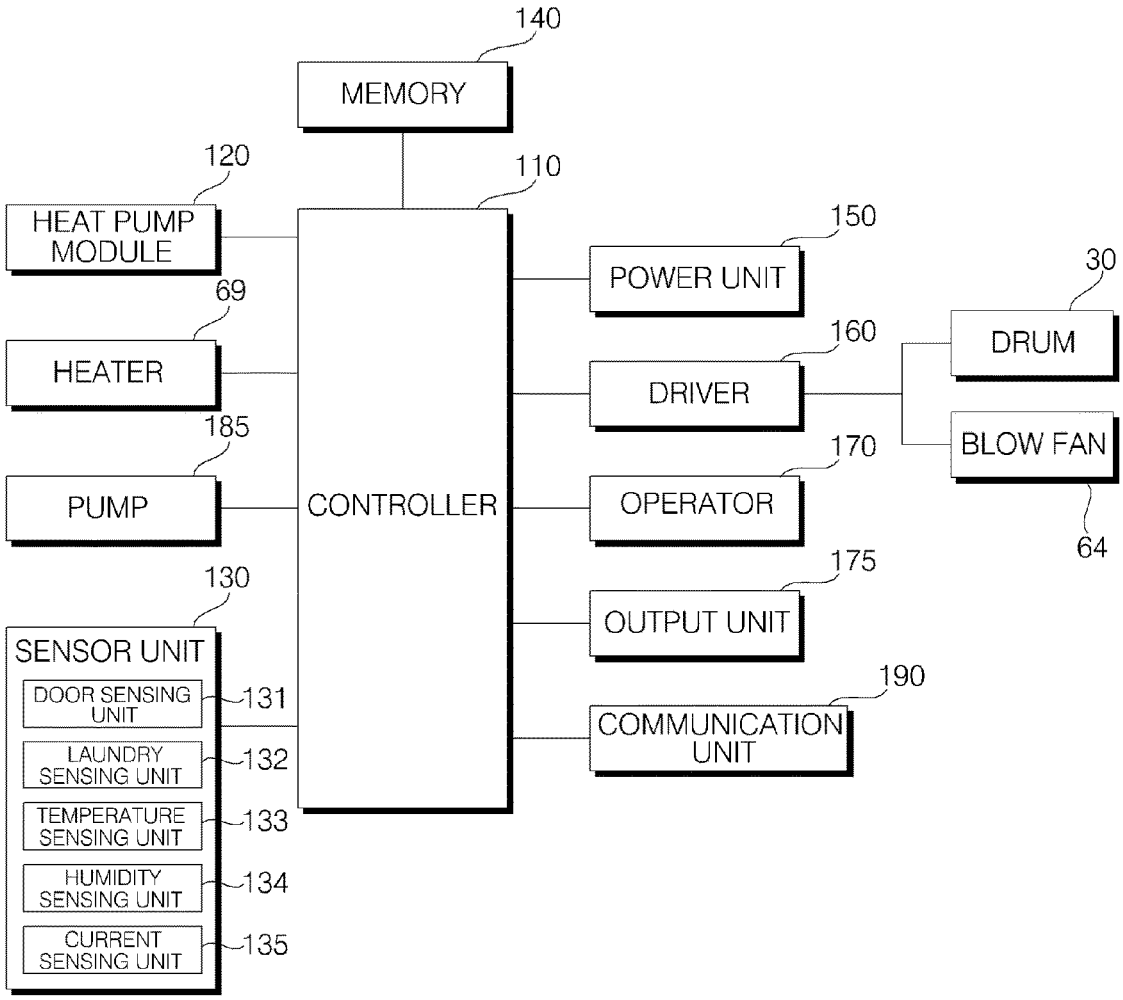
FIG. 6 is a block diagram briefly illustrating control configuration of a dryer according to an embodiment of the present disclosure.

FIG. 6 is a block diagram briefly illustrating control configuration of a dryer according to an embodiment of the present disclosure. As illustrated in FIG. 6, the dryer 1 is configured as described above, and, in order to control operations, the dryer 1 includes an operator 170, an output unit 175, a communication unit 190, a driver 160, a power unit 150, a heat pump module 120, a pump 185, a heater 69, a sensor unit 130, a memory 140, and a controller 110 for controlling overall operations of the dryer.

The operator 170 includes an input means such as at least one button, switch, or touch pad installed on the control panel 17. The operator 170 inputs an operation settings which includes a power input, an operation mode, and a laundry type setting. When a type of laundry is selected and a power key is input, the operator 170 may input data on the operation setting to the controller.

The output unit 175 includes: a display for displaying information on the operation setting input by the operator 170 and for outputting an operation state of the dryer; and a speaker or a buzzer for outputting voice guidance, specific sound effect, or warning sound. The display may include a menu screen for operation settings and operation control of the dryer, and output a guidance message or an alarm including at least one or a combination of a text, a numeric value, and an image with respect to the operation setting or the operation state.

The memory 140 may store control data for operation control of the dryer, input operation setting data, data on an operation mode, and reference data used to determine an error of the dryer. In addition, the memory 140 stores data sensed or measured during operation of the dryer, and data transmitted and received through the communication unit. The memory 140 may be a hardware storage device, such as a ROM, a RAM, an EPROM, a flash drive, and a hard drive.

The communication unit 190 transmits and received data in a wired or wireless manner. The communication unit 190 may be connected to a network formed in a building or at a predetermined distance, such as a home network, to transmit and receive data, may be connected to an external server, such as the Internet, and may communicate with a terminal having a control function. The communication unit 190 transmits an operation state or a drying operation progress state of the dryer, and receives a command in regard of the dryer. The communication unit 190 includes not just a short range communication module, such as Zigbee and Bluetooth, but also a communication module, such as Wi-Fi and Wibro, to transmit and receive data.

The power unit 150 supplies operation power by converting supplied normal power. The power unit blocks excessive currents and rectifies and smooths supplied power, thereby supplying operation power of a predetermined size.

The sensor unit 130 includes a plurality of sensors, measure a voltage or current of the dryer, senses a rotation speed of the motor, temperature, and humidity, and inputs measurements to the controller 110.

The sensor unit 130 includes a door sensing unit 131, a laundry sensing unit 132, a temperature sensing unit 133, a humidity sensing unit 134, and a current sensing unit 135. The sensor unit 130 may further include a pressure sensor for sensing pressure of a refrigerant of the heat pump module 120, a temperature sensor, and a speed sensing unit for sensing a rotation speed of the motor of the driver or a rotation speed of the drum.

The temperature sensing unit 133 may sense internal temperature of the drum, temperature of the refrigerant or the heat exchanger in the heat pump module 120, temperature of the heater 69, and internal temperature of the control circuit. In addition, the temperature sensing unit includes a plurality of sensors respectively installed at different positions to sense temperature.

The humidity sensing unit 134 senses internal humidity of the drum and humidity of circulating air.

The laundry sensing unit 132 may contact laundry accommodated in the drum to sense an amount of moisture contained in the laundry. The laundry sensing unit may be included in the humidity sensing unit and may be installed separately from the humidity sensing unit.

The current sensing unit 135 may sense a current applied to the motor of the driver 160 and input the sensed current value to the controller 110.

The door sensing unit 131 may sense whether the door 20 is opened or closed. Before performing an operation in accordance with a setting, the door sensing unit 131 senses an opened/closed state of the door and inputs a sensing signal to the controller. In addition, the door sensing unit 131 senses whether laundry is jammed The heater 69 heats up air being supplied to the drum, so that the air reaches to a predetermined temperature.

A heater driver (not shown) supplies operation power to the heater 69 so as to operate the heater or stop operation of the heater, and controls heating temperature of the heater. The heater driver may control the heater in different manners with respect to the case where the heater 69 operates alone and the case where the heater 69 operates along with the heat pump module 120 at the same time.

The pump 185 operates by a pump driver (not shown) and discharges condensate to the outside. The pump 185 discharges condensate accommodated in the condensate housing, the condensate which is generated through condensation of moisture, recollected by the drum from air, in the evaporator.

The driver 160 controls driving of the motor to rotate the motor. The motor is connected to the drum 30 and provides power to the drum to rotate the drum. In addition, the motor is connected to the blow fan 64, rotating the blow fan.

As the drum and the blow fan are connected to a single motor, the driver 160 controls the drum and the blow fan at the same time by controlling the motor. As the drum is connected to the motor through the drive belt and the pulley, the number of times of rotation of the motor per rotation of the drum has a predetermined ratio. A rotation speed of the motor is different from a rotation speed of the drum. For example, the drive pulley may be installed to allow the motor to rotate 40 to 60 times while the drum rotates once. The blow fan may rotate at a speed identical to the rotation speed of the motor according to a structure of connection with a driving shaft of the motor.

The blow fan 64 controls a flow of air in the dryer. The blow fan 64 supplies heated air to the drum 30, suctions moisture-contained air from the drum, and causes the moisture-contained air to flow to the heat pump module 120.

The heat pump module 120 includes the compressor 50 and a heat exchanger, thereby removing moisture from circulating air through heat exchange with a refrigerant and heating up the air.

The controller 110 performs control to store an operation setting, received from the operation unit 170, in the memory 140, process data transmitted and received through the communication unit 190, and output the operation setting and an operation state of the dryer through the output unit 175. When an application for controlling the dryer is installed and there is a terminal (not shown) wirelessly connected with the dryer, the controller may control the communication unit to transmit data of the dryer to the terminal.

The controller 110 controls operation of the drum and the blow fan by means of the driver 160 according to the operation setting received from the operation unit 170, and variably controls operation according to a sensing value of the sensor unit 130. The controller 110 controls the heat pump module 120 during operation to heat up air, and controls either or both of the heater and the heat pump module to operate so as to control temperature of air supplied to the drum.

The controller 110 controls a series of procedures for drying laundry loaded into the drum.

The controller 110 senses an amount (quantity) of laundry loaded into the drum, and sets a drying time according to the amount of the laundry. Upon operation of the motor, the controller 110 stores and analyzes a current value sensed by the current sensing unit 280 to determine a state of the motor and determine the amount of the laundry accommodated in the drum.

In the case of sensing an amount (quantity) of the laundry, if the motor rotates by the driver 160, the controller 110 applies a control command so as to increase a rotation speed of the motor to a preset rotation speed, maintain the preset rotation speed for a predetermined time period, and then stop the rotation. The controller 110 determines an amount of the laundry by analyzing current values sensed by the current sensing unit 135 in an acceleration stage in which the motor reaches the preset rotation speed, and a maintaining stage in which the preset rotation speed is maintained.

In addition, when sensing an amount (quantity) of the laundry, the controller 110 may control the driver 160 such that the drum repeatedly performs an operation of rotating in one direction, rotating in the opposite direction, and rotating in one direction again.

While the amount (quantity) of the laundry is being sensed, the controller 110 controls the heat pump module 120 to stop operating, and, when the amount of the laundry is sensed, the controller 110 may control the heat pump module to operate according to a setting.

The controller 110 sets a rotation speed of the motor so that the drum rotates at a predetermined rotation speed. The controller sets a rotation speed of the drum so that laundry in the drum is dropped while moving along with the drum by the rotation of the drum. When the drum rotates by the motor, the blow fan 64 rotates along with the rotation of the drum 30, thereby causing air to flow through the circulation flow path.

During a drying operation, the controller 110 may determine whether laundry is properly dried, based on data sensed and received by a plurality of sensors in the sensor unit 130. According to a dry state of laundry sensed by the laundry sensing unit, the controller 110 changes a drying time or a rotation speed of the drum. In addition, when an error occurs during the drying operation, the controller 110 may perform control to output the error through the output unit 240 and stop operation of the dryer according to the occurred error.

Figure 7:
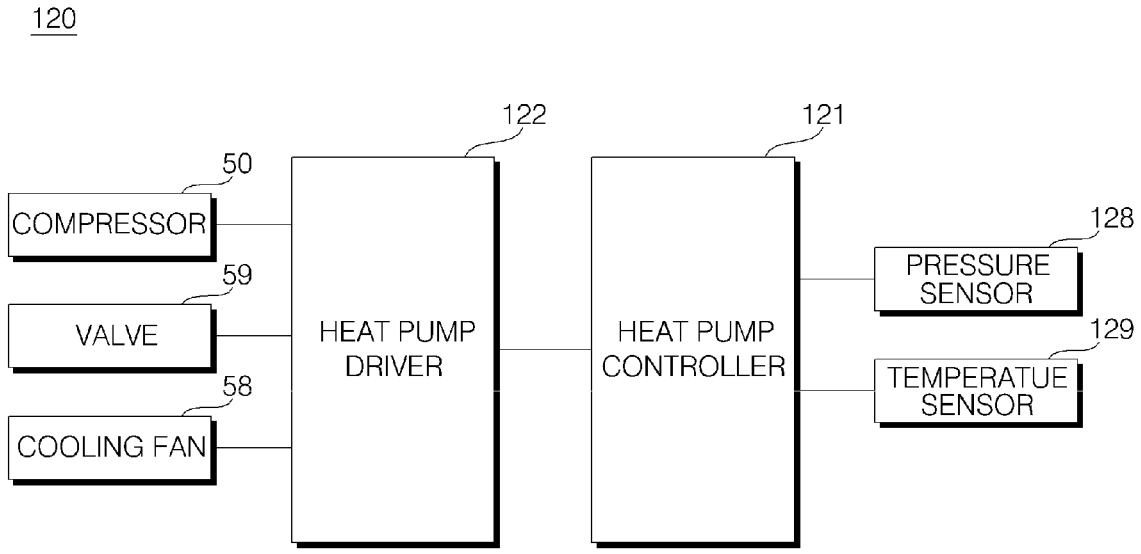
FIG. 7 is a block diagram briefly illustrating control operation of a heat pump of a dryer according to the present disclosure.

FIG. 7 is a block diagram briefly illustrating control operation of a heat pump of a dryer according to the present disclosure.

As illustrated in FIG. 7, the heat pump module 120 may further include a heat pump controller 121, a heat pump driver 122, a compressor 50, a valve 59, a cooling fan 58, a pressure sensor 128, a temperature sensor 129, a condenser 52, and an evaporator 53. In addition, the heat pump module 120 further include an auxiliary heat exchanger.

The heat pump controller 121 controls the compressor 50 to operate in accordance with a control command from the controller 110. The heat pump controller 121 sets an operation frequency of the compressor, variably controls the compressor in accordance with data sensed by the pressure sensor 128 and the temperature sensor 129, and controls a rotation speed of the cooling fan 58.

The heat pump driver 122 controls driving of the compressor 50, the valve 59, and the cooling fan 58. The heat pump driver 122 may be classified into a compressor driver, a valve driver, and a fan driver which are provided separately.

The heat pump driver 122 supplies operation power so that the compressor 50 operates according to a setting by the heat pump controller 121. The heat pump driver 122 may include an inverter (not shown). The heat pump driver 122 control opening and closing of the valve 59 which controls a flow of a refrigerant. For example, the heat pump driver 122 controls a four-way valve to change a flow path of a refrigerant, and controls opening and closing of the valve 59 with respect to a refrigerant discharged from the condenser such that the refrigerant expands and is evaporated in the evaporator 53.

The heat pump driver 122 supplies operation power to a fan motor so that the cooling fan 58 is rotated. The cooling fan 58 is rotated at a predetermined rotation speed upon driving of the fan motor. The cooling fan 58 may be provided in an auxiliary heat exchanger 54. The auxiliary heat exchanger 54 is configured by a separate condensing module separable from the condenser 52, and installed in a refrigerant pipe connected from the condenser to the expansion valve with reference to a refrigerant flow direction to cool down a refrigerant discharged from the condenser. The cooling fan 58 transfers external or internal air of the cabinet to the auxiliary heat exchanger, thereby cooling down the auxiliary heat exchanger.

Refrigerants in the condenser 52 and the evaporator 53 thermally exchange with air circulating in the drum. Additional fans are not installed in the condenser and the evaporator, and heat is exchanged with air circulated by the blow fan 64.

The refrigerant flows in a sequence of the compressor 50, the condenser 52, and the evaporator 53, and the air circulates in a sequence of the drum, the evaporator, and the condenser. The air may pass through the heater 69 before being supplied from the condenser to the drum.

The compressor 50 discharges a refrigerant of high temperature and high pressure, and the condenser 52 condenses the refrigerant and discharges the condensed refrigerant. Here, since heat is generated in the course of condensing the refrigerant by the condenser, air passing through the condenser is heated up by the heat generated by the condenser.

The refrigerant discharged from the condenser is evaporated in the evaporator by the expansion valve. Since an endergonic reaction, in which surrounding heat is absorbed during vaporization of a refrigerant, occurs in the evaporator, air passing through the evaporator is cooled down and moisture contained in the air is condensed, thereby generating condensate.

As the moisture cooled down in the evaporator 53 is generated as condensate, the air is dehumidified and then supplied to the condenser. Air passing through the condenser is heated up and then supplied to the drum.

Figure 8:
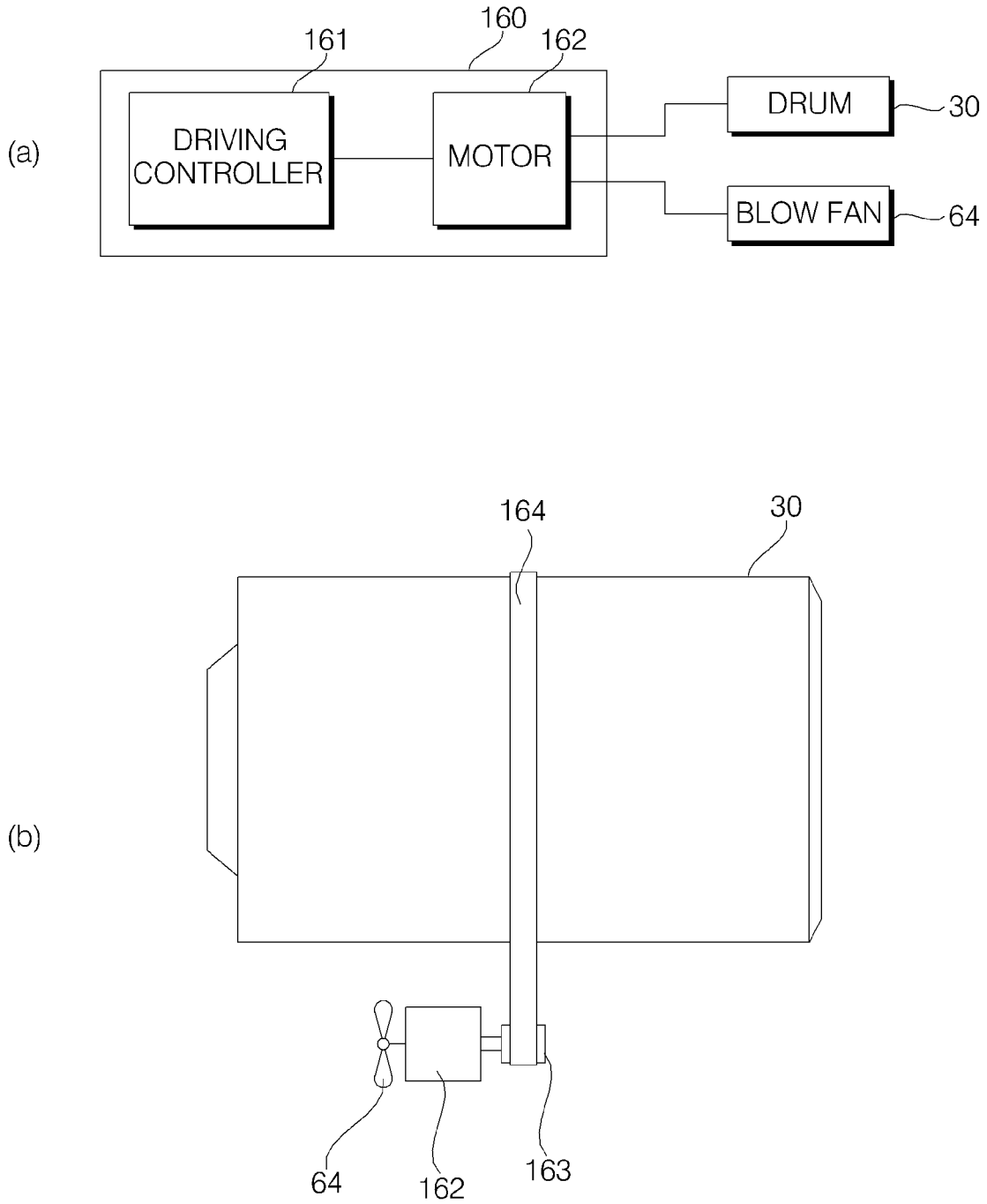
FIG. 8 is a diagram for explanation of configuration and operation for driving a drum and a blow fan of a dryer according to an embodiment of the present disclosure.

FIG. 8 is a diagram for explanation of configuration and operation for driving a drum and a blow fan of a dryer according to an embodiment of the present disclosure.

As illustrated in (a) of FIG. 8, the driver 160 includes a driving controller 161 and a motor 162. The driving controller 161 applies operation power to the motor 162 such that the motor rotates at a preset rotation speed.

In accordance with a control command from the controller 110, the driving controller 161 controls the motor to operate or stop operating, and also controls a rotation speed of the motor such that the motor operates at a preset rotation speed.

In accordance with a control command, the driving controller 161 controls a rotation direction, a rotation angle, and a rotation speed of the motor 162. In response to operation of the motor 162, the drum 30 and the blow fan 64 operate.

As illustrated in (b) of FIG. 8, with the drive belt 164 is wound around the drum 30, and, as the drive belt 164 moves by rotation of the motor 162, the drum rotates along with the drive belt by a friction force between the drive belt and the drum.

As the blow fan 64 is connected to the other shaft of the motor 162, the blow fan rotates along with the drum upon rotation of the motor.

When the motor rotates forward, the drum rotates forward as well. When the motor rotates forward, air flows from the back of the drum to the inside of the drum by the blow fan, and air is suctioned into a circulation flow path, provided on the front surface of the drum, passes through the evaporator and the condenser, and then flows to the drum again, thereby circulating.

Meanwhile, when the motor 162 rotates backward, the drum 30 and the blow fan 64 rotates backward as well. Due to the backward rotation of the blow fan, air is supplied to the front surface of the drum, flows to the rear surface of the drum, and then passes through the condenser and the evaporator. When the blow fan rotates backward, the air passing through the evaporator is supplied to the drum, and therefore, unheated air flows to the drum.

The driving controller 161 may control the motor to rotate forward during a drying operation so as to rotate the drum and the blow fan forward, while controlling the motor to rotate backward a predetermined number of times during the drying operation so as to prevent entanglement of laundry.

In the case where the motor rotates by suddenly accelerating a rotation speed thereof as the drum 30 rotates by the drive belt 164, a slip between the drum and the drive belt may occur. That is, even when the motor is rotating, a slip between the drive belt and the drum may occur and thus the drum is not capable of rotating in correspondence with the rotation speed of the motor.

Accordingly, the driving controller 161 controls the motor 162 such that a target speed is reached by accelerating for a predetermined time period, rather than immediately accelerating up to the target speed from the beginning. A degree of acceleration in the rotation speed of the motor in an acceleration stage is described as an acceleration gradient.

Due to the characteristic that a driving force of the motor is transferred to the drum by the belt, the controller 110 sets a degree of acceleration of the motor to reach a target rotation speed, thereby causing the drum to rotate without a slip.

Figure 9:
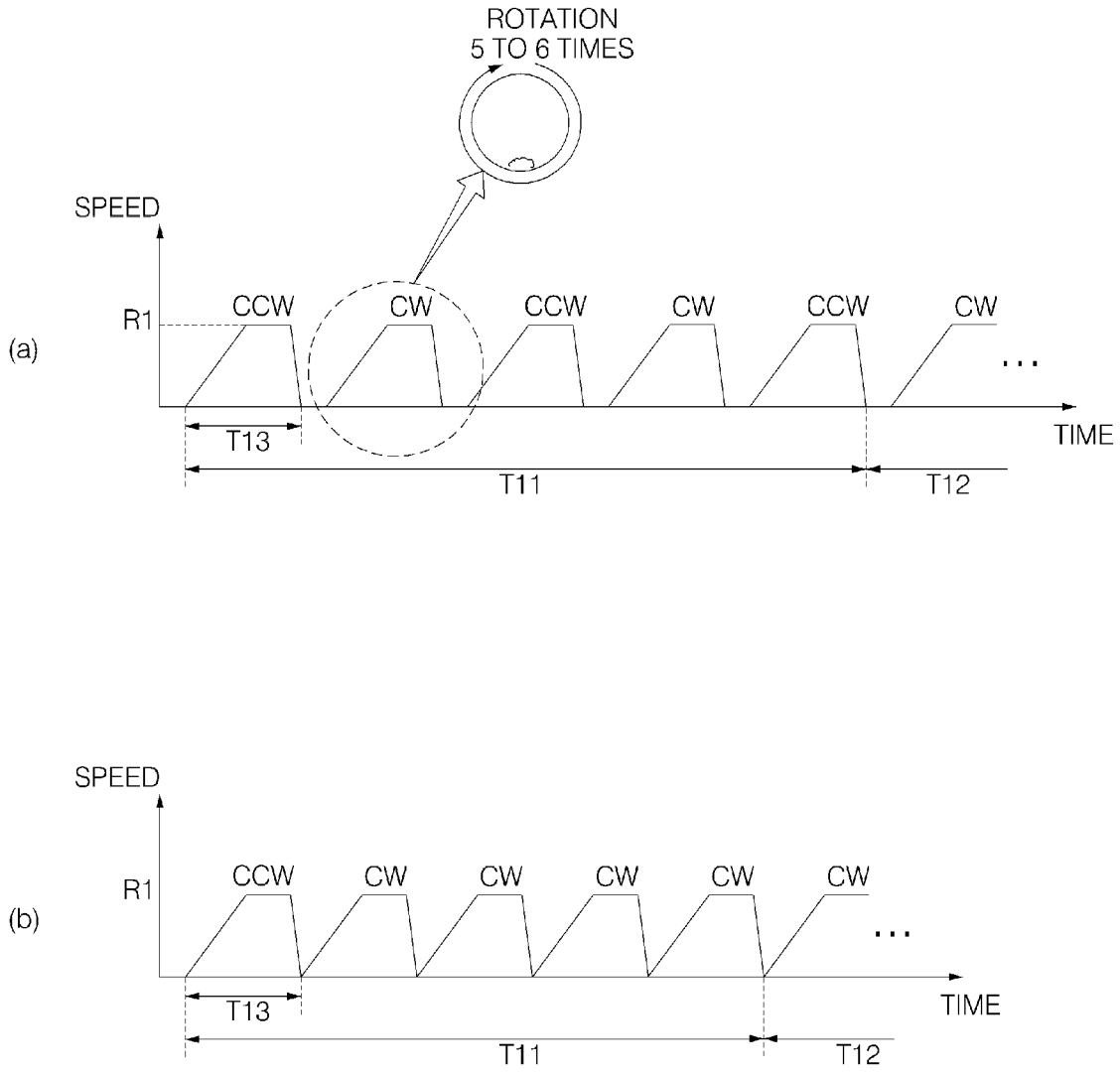
FIG. 9 is a diagram illustrating an operation pattern for sensing an amount of laundry in a dryer according to an embodiment of the present disclosure.
Figure 10:
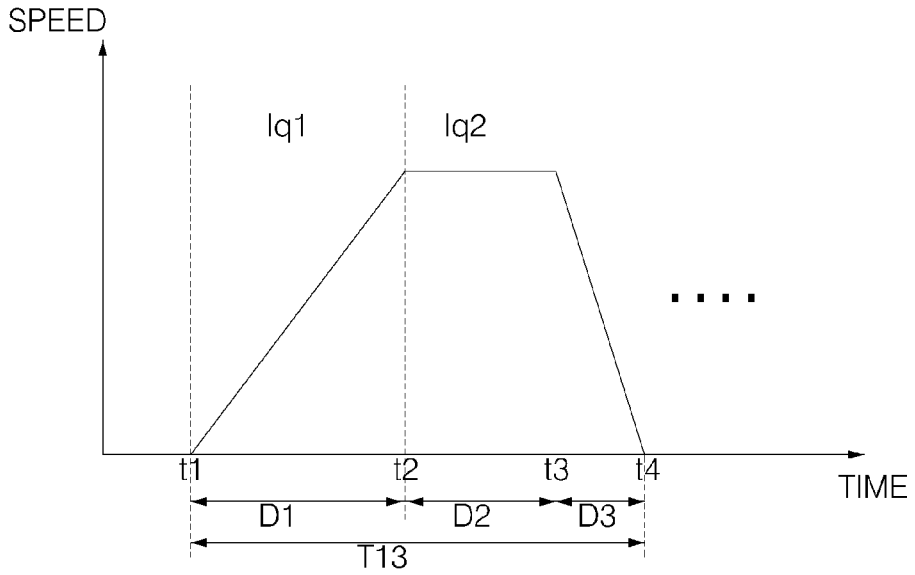
FIG. 10 is a diagram for explanation of the operation pattern shown in FIG. 9.

FIG. 9 is a diagram illustrating an operation pattern for sensing an amount of laundry in a dryer according to an embodiment of the present disclosure, and FIG. 10 is a diagram for explanation of the operation pattern shown in FIG. 9.

As illustrated in (a) of FIG. 9, the controller 110 controls a rotation speed of the motor in order to determine an amount of laundry.

The controller 110 divides an operation of the dryer into a sensing step of sensing the amount of laundry, and a drying step of performing a drying operation to dry the laundry.

In the sensing step, the controller 110 repeatedly performs an operation pattern to sense an amount of laundry.

The controller 110 may control the driver 60 such that the drum repeatedly performs an operation of stopping after rotation in any one direction and rotating in the opposite direction after a predetermined time period. During the rotation of the drum, the controller 110 stores a current value for each stage, measured by the current sensing unit 135, and determine the amount of laundry.

Hereinafter, based on an operation pattern which indicates that the drum 30 rotates in any one direction for a preset time period, an operation of the drum in an effort to sense the amount of laundry will be described.

The controller 110 senses an amount of laundry for an $11^{th}$ time period T11. The sensing step may be set to the $11^{th}$ time period. When the amount of laundry is sensed, the controller 110 controls the driver to perform a drying operation in the drying step. The drying step may be set to a $12^{th}$ time period, and correspond to a time period which lasts until operation of the dryer is terminated.

During the $11^{th}$ time period T11, the controller 110 senses the amount of laundry five to six times.

The controller 110 controls the driver to repeatedly perform the operation pattern during the $11^{th}$ time period with changing a rotation direction.

The controller 110 performs control to perform the operation pattern just once for a $13^{th}$ time period T13 and sense the amount of laundry just once for the $13^{th}$ time period. In the operation pattern for the $13^{th}$ time period T13, the drum rotates five to six times. Regardless of directions of forward rotation and backward rotation, the operation time and the sensing time are applied identically.

The operation pattern includes an acceleration stage in which a speed is accelerated to a target rotation speed, a maintaining stage in which the rotation speed is maintained, and a stopping stage in which the rotation is stopped.

In the operation pattern being performed while an amount of laundry is sensed, a rotation speed R1 may be a target rotation speed which corresponds to a degree of speed at which the laundry is lifted by rotation of the drum and dropped. For example, in the case of sensing an amount of laundry is measured, the rotation speed R1 of the drum may be set to 39 rpm to 63 rpm. A rotation speed of the motor corresponding to the rotation speed of the drum may be set to 2000 rpm to 3200 rpm but may vary depending on a pulley ratio.

In addition, as illustrated in (b) of FIG. 9, the controller 110 may control the driver 60 such that the drum 30 repeatedly performs an operation of rotating in any one direction, stopping rotating, and then immediately rotating in the opposite direction.

In this case, as described above, a time period required to perform the operation pattern once is identical to the $13^{th}$ time period, yet, since the drum immediately rotates, a time period required to sense an amount of laundry may be a $14^{th}$ time period T11' shorter than the $11^{th}$ time period T11.

The controller 110 may control the driver 160 such that an amount of laundry is sensed through backward rotation, forward rotation, backward rotation, forward rotation, and then backward rotation of the drum 30, and an drying operation T12 is performed while the drum is kept rotating forward. The controller 110 may perform control to perform a preset drying operation after sensing the amount of laundry. In this case, rotation of the drum in a clockwise direction is defined as forward rotation, and rotation of the drum in a counter-clockwise direction is defined as backward rotation.

In addition, in the case of sensing an amount of laundry, if the first rotation direction is a forward direction, the controller 110 may sense the amount of laundry six times. For example, the drum 30 may rotates forward, backward, forward, backward, forward, and backward, and then perform a drying operation while rotating forward. In addition, an example is also possible in which the drum 30 senses an amount of laundry five times by starting with forward rotation, temporarily stops rotating, and then performs a drying operation while rotating forward.

The controller 110 senses an amount of laundry five to sixth time by repeatedly rotating backward and forward for the $11^{th}$ time period T11 or for the $14^{th}$ time period T11'. In some cases, when the amount of laundry is sensed, a drying operation may be performed after the drum rotates five times in any one direction consecutively, or an operation in which the drum rotates two times in any one direction, rotates in the opposite direction, and rotates in the any one direction again may be performed repeatedly. When the amount of laundry is sensed, any of various rotation directions of the drum may be set, but the controller 110 controls the driver such that the drum 30 operates in accordance with the operation pattern including the acceleration stage, the maintaining stage, and the stopping stage.

In the case where the drum 30 rotates forward, as heated air is supplied to the drum, the drum rotates forward in the drying operation. During the drying operation, the drum may rotate backward a predetermined number of times in order to prevent entanglement of laundry.

As illustrated in FIG. 10, when sensing the amount of the laundry, the controller 110 applies a control command to the driver 160 such that the drum rotates in accordance with the operation pattern.

When sensing the amount of the laundry, the controller 110 may divides the operation pattern into an acceleration stage D1 in which a rotation speed increases to a target rotation speed R1, and a maintaining stage D2 in which the target rotation speed is maintained. In addition, the controller 110 may perform control by further adding a stopping stage D3 which comes after the maintaining stage, and in which the rotation speed of the drum is decelerated to stop.

The controller 110 may set the acceleration stage D1 and the maintaining stage D2 such that a length of the acceleration stage D1 is longer than a length of the maintaining stage. In addition, the controller 110 may set a length of the stopping stage D3 to be shorter than the length of the maintaining stage D2. In this case, a length of each stage refers to a time period, and the fact that the length of the acceleration stage is longer than the length of the maintaining stage means that a time period in which the rotation speed of the drum is accelerated is longer than a time period in which the rotation speed is maintained.

For example, the length of the acceleration stage D1 and the length of the maintaining stage D2 may be set to a ratio of 5:3.

In addition, when the stopping stage D3 is included, the length of the acceleration stage D1, the length of the maintaining stage D2, and the length of the stopping stage may be set to a ratio of 5:3:2.

For example, when the $13^{th}$ time period required to perform the operation pattern once is assumed to be 10 seconds, the acceleration stage, the maintaining stage, and the stopping stage may be set to 5 seconds, 3 seconds, and 2 seconds, respectively. The ratio regarding the lengths of the stages may be varied, but, since a slip can occur by the belt of the drive pulley which connects the motor and the drum, it is preferable to make setting so as to prevent occurrence of the slip.

In the case where a driving torque of the motor is constant, if a speed increases, a friction torque decreases, possibly causing the slip to occur. Thus, an acceleration speed may be set within a range in which the slip does not occur.

A rotation speed of the drum should not be accelerated unexpectedly in order to prevent the slip, and thus, the acceleration stage may be set such that the rotation speed increases at a preset acceleration gradient. Accordingly, the acceleration stage is preferably set to be longer than the maintaining stage. The acceleration gradient refers to a variation of acceleration.

A time period in which the target rotation speed is reached in the acceleration stage may be varied according to the acceleration gradient, but the controller 110 may determine an amount of laundry by calculating a current values for each stage with reference to a designated time period.

When the drum 30 is performing the operation pattern of accelerating, retaining, and stopping for the $13^{th}$ time period, the drum rotates five to six times. In one operation pattern, the controller senses an amount of laundry using a current value sensed by the current sensing unit 135. The controller may and senses an amount of laundry using a sensed current value for each of the acceleration stage, the maintaining stage, and the stopping stage which are set at time intervals identically set regardless of a rotation direction of the drum.

When sensing the amount of laundry, the controller 110 discriminates current values, sensed by the current sensing unit 135, for the acceleration stage D1, the maintaining stage D2, or the stopping stage D3 according to a preset ratio. The controller 110 performs control such that the drum repeatedly performs the operation pattern a preset number of time with changing a rotation direction of the drum to a forward direction and a backward direction.

During one round of the operation pattern in which the drum rotates in three stages including the acceleration stage, the maintaining stage, and the stopping stage, the controller 110 discriminates current lq1 and lq2, measured by the current sensing unit 135, for the respective stages, and stores and accumulates the discriminated currents lq1 and lq2 according to the respective stages. The controller 110 determines an amount of laundry by calculating an average of current values in the acceleration stage D1 and an average of current values in the maintaining stage D2.

The controller 110 repeatedly performs the operation pattern five to six times, and senses the amount of laundry for the $11^{th}$ time period T11 or for the $14^{th}$ time period T11' with the stopping stage added. For example, if the $13^{th}$ time period T13 for performing the operation pattern once is 10 seconds and the operation pattern is performed five times, a time period for sensing an amount of laundry may be set to about 50 to 60 seconds.

The controller 110 calculates an average of current values for each stage, sensed during each round of the operation pattern, and determines the amount of laundry based on a value obtained by subtracting a current value of the maintaining stage from a current value of the acceleration stage. The controller 110 calculates the amount of laundry into a value obtained by subtracting a half the average current value of the maintaining stage from the average current value of the acceleration stage.

In order to reduce an error caused by a type of laundry and a friction force between the drum and the drive belt, the controller 110 subtracts a half the (average) current value of the maintaining stage.

An average of current values aggregated in the acceleration stage is an average of currents that are consumed to reach to a target rotation speed from a stopped state, and 50% of the influence of current components by friction is applied. In addition, as for an average of currents in the maintaining stage, 100% of the friction coefficient of the drive belt 164 and the drum 30 are applied, and thus, 100% of the influence of the friction is applied.

Accordingly, in order to eliminate the influence of the friction of the drive belt 164, the controller 110 subtracts an average of current values in the maintaining stage from an average of current values in the acceleration stage, and, since 50% of the influence of the friction in the acceleration stage is applied and 100% of the influence of the friction in the maintaining stage is applied, the controller 110 may determine an amount of laundry into a value obtained by subtracting a half the average of current values in the maintaining stage from the average of current values in the acceleration stage.

Figure 11:
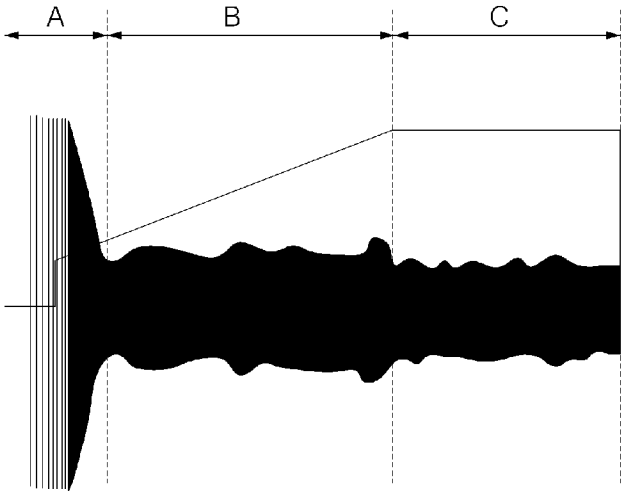
FIG. 11 is a diagram illustrating a current waveform sensed in accordance with the operation pattern shown in FIG. 9.
Figure 11:
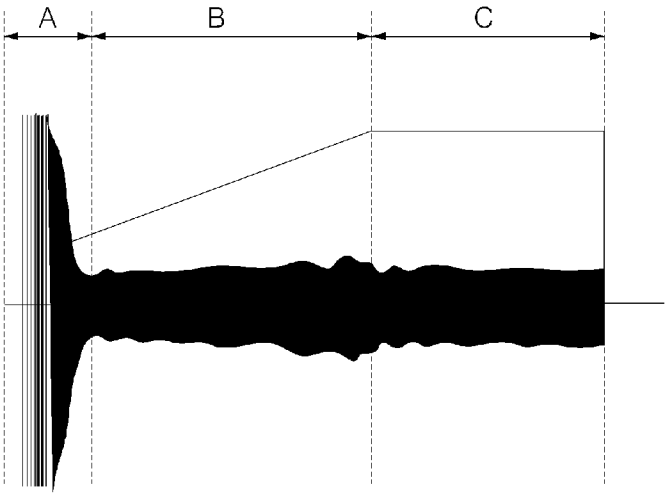

FIG. 11 is a diagram illustrating a current waveform sensed in accordance with the operation pattern shown in FIG. 9.

As illustrated (a) and (b) of FIG. 11, a different current value is measured by the motor according to the amount of laundry.

When the amount of laundry is small, a current value is measured low, except for an initial driving current, As illustrated (a) of FIG. 11. And when there is a great amount of laundry, a current value is measured higher than in (a) of FIG. 11, as illustrated (b) of FIG. 11.

Accordingly, an amount of laundry may be determined based on a current value used to rotate the drum with laundry loaded therein.

The current sensing unit 135 may measure currents according to an initial driving stage A, an acceleration stage B, and a maintaining stage C. In the initial driving stage, there is a big error due to a position of laundry or positional alignment of the motor in the initial driving, and a big error in current values at an initial driving time, and thus, a current value of the initial driving stage A may be excluded. When necessary, the initial driving stage may be included in the acceleration stage.

The controller 110 controls the driver to accelerate such that the rotation speed of the drum 30 increases to reach a target rotation speed. While the drum 30 is rotating, laundry in the drum 30 is initially in a (tumble) state in which the laundry is rotating and rolling in the drum, and, as the rotation speed of the drum 30 increases, an amount of movement of the laundry increases due to a centrifugal force in the drum. When the rotation speed of the drum 30 reaches the target rotation speed, the laundry is in a state in which the laundry is lifted by the rotation of the drum and dropped.

The controller 110 performs control to accelerates the rotation speed of the motor to a degree in which the laundry is lifted by the rotation of the drum and then dropped, and then to maintain the rotation speed.

When the drum rotates upon operation of the dryer, a variety of forces is applied to the drum with laundry loaded therein. When the drum rotates, a motor torque, an inertia torque, a friction torque, and a load torque are applied to the drum.

The motor torque is a force applied to rotate the motor connected to the drum; the initial torque is a force caused by inertia to maintain the existing movement state (rotation) when a speed is accelerated or decelerated during the rotation; the friction torque is a force resisting rotation by friction between the drum and the laundry, between the door and the laundry, between in the laundry, and between the drive belt and the drum; and the load torque is a force resisting rotation by a weight of the laundry.

While the drum is rotating, a force applied to the laundry at an angle of em is as follows. This is a force applied when the drum is moved by the angle of em from a stopped state.

The motor torque is a force required to operate the motor, and represented as a sum of the inertia torque, the friction torque, and the load torque. The motor torque is a value obtained by multiplying a force of lifting the laundry by a radius of the drum. The inertia torque is a force resisting rotation by inertia of the drum or inertia according to a distribution of laundry when a rotation speed is accelerated or decelerated during the rotation. In this case, the inertia torque is proportional to a weight of the laundry and a square of the radius of the drum. The friction torque is a friction force applied between laundry and a tub, between laundry and a door, and between a drive belt and a drum, and therefore, the friction torque is proportional to a rotation speed. The friction torque may be calculated into a value of multiplication between a friction coefficient and the rotation speed. The load torque is a force of gravity applied according to a distribution of the laundry, and may be calculated based on a weight of the laundry, acceleration due to gravity, the radius of the drum, and an angle.

The force of gravity influences a force applied to the laundry at a specific angle θm, but, since the drum is rotating, the applied force may be calculated into a value obtained by multiplying gravity by sin θm. The force of gravity is determined by acceleration due to gravity, the radius of the drum, and the weight of the drum.

While the drum is rotating, the motor torque, the inertia torque, the friction torque, and the load torque are applied at the same time and these force components are reflected in a current value of the motor, and therefore, the controller 110 calculates an amount of laundry using current values sensed by the current sensing unit 135 during operation of the motor.

The motor torque is considerably influenced by gravity due to a weight, and, if the weight is equal to or greater than a predetermined weight, resolution is reduced. That is, in the case where an amount of laundry increases to be equal to or greater than a predetermined level, as the amount of laundry increases, a discrimination capacity according to the weight of laundry is reduced.

A variation of the friction torque increases by friction between laundry and a door and upon jamming of the laundry at the door, and accordingly, the spread or dispersion of the friction torque increases. In particular, if an amount of laundry increases, the spread or dispersion of the friction torque increases significantly.

Due to movement of laundry, a deviation of the load torque occurs. In addition, if a weight of laundry is equal to or greater than a predetermined value, the movement of the laundry decreases and thus the load torque is reduced.

While the inertia torque is influenced by movement of laundry, the inertia torque has a linearity with respect to the amount (weight) of laundry and thus an amount of laundry may be measured more accurately.

Since the inertia torque is a force resisting to maintain the status quo, the inertia torque is applied upon acceleration or deceleration. That is, the inertia torque is applied in an acceleration stage and a deceleration stage, but, when a rotation speed is maintained constantly, the inertia torque is not applied and instead the motor torque, a friction torque, and the load torque are applied by gravity.

Thus, a property regarding the inertia torque may be calculated by excluding data of the maintaining stage from data of the acceleration stage. Inertia may be calculated by subtracting a current value of the maintaining stage from a current value of the acceleration stage and a current value of the deceleration period, dividing a result of the subtraction by a variation of speed per hour, that is, acceleration, and multiplying a result of the division by a counter electromotive force.

Thus, the dryer may determine an amount of laundry based on an inertia torque by analyzing a force applied in the acceleration stage and the maintaining stage, and the dryer may, in the maintaining stage, calculate a force of gravity according to the amount of the laundry. The inertia property is minimized in the maintaining stage, and the inertia greatly acts in the acceleration stage and the deceleration stage, and therefore, a final amount of laundry may be determined by calculating a laundry quantity sensing value for each stage based on different data and analyzing the calculated value in a comparative manner.

In addition, as the dryer calculates an amount of laundry by measuring a current value during rotation of the motor, a possibility of an error caused by a positional arrangement of the motor may be ruled out in operation, and, it is possible to minimize an error caused by a change in a load state in the maintaining stage, that is, a variation of the load, since the laundry moving regularly, not irregularly.

Figure 12:
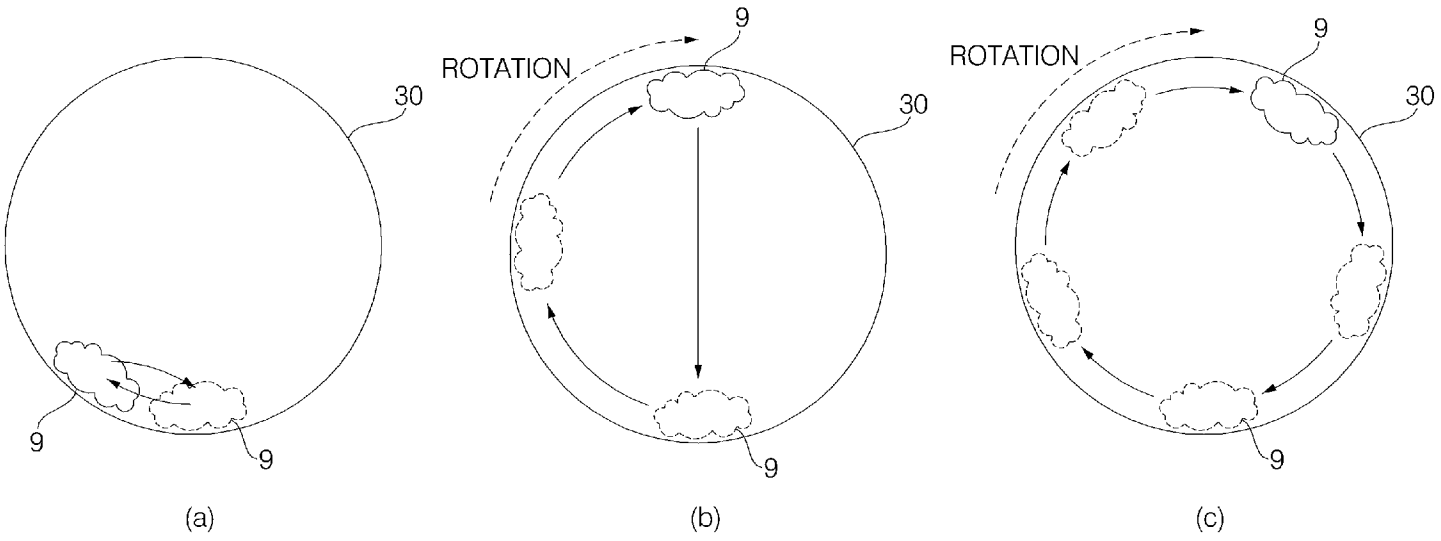
FIG. 12 is a diagram for explanation of movement of laundry in accordance with a rotation speed of a dryer according to an embodiment of the present disclosure.

FIG. 12 is a diagram for explanation of movement of laundry in accordance with a rotation speed of a dryer according to an embodiment of the present disclosure.

As illustrated in FIG. 12, when sensing the amount of laundry 9, the controller 110 rotates the drum 30 in a stopped state in any one direction so as to accelerate for a predetermined time period to a target rotation speed, maintains the target rotation speed for a predetermined time period, and then stops the drum.

Once the drum starts rotating, when a rotation speed is a low speed, the laundry 9 is in a state of rotating and rolling in the drum, as illustrated in (a) of FIG. 12, and, as the rotation speed increases, the laundry 9 is lifted up by the drum, increasing the amount of movement of the laundry 9.

As illustrated in (b) of FIG. 12, if the rotation speed of the drum 30 increases, the laundry 9 is lifted by a centrifugal force of the drum and then dropped.

In addition, if the rotation speed of the drum further increases, the laundry 9 is stuck with the drum and thus rotates along with the drum 30, as illustrated in (c) of FIG. 12.

As illustrated in (b) of FIG. 12, the controller 110 sets the target rotation speed to a degree of speed in which the laundry 9 moves along with the drum by the rotation of the drum 30 and is dropped from the top of the drum.

As illustrated in the drawing, if the rotation speed of the drum is a low speed, the amount of movement of the laundry is small, and, if the rotation speed of the drum increases, the laundry rotates along with the drum while being stuck with the drum by a centrifugal force. In order to dry the laundry, air should be allowed to pass through the laundry, and thus, at a time of sensing the amount of the laundry, a target rotation speed may be set to a rotation speed at which the laundry moves along with the drum and is dropped due to gravity acting greatly than the centrifugal force. The target rotation speed may be set identical to a normal rotation speed.

The rotation speed (target rotation speed) of the drum may be set in a range of 39 rpm to 63 rpm. At a time of measuring an amount of laundry, the drum may rotate at 57 rpm. In this case, if a pulley is provided in the motor with a ratio of 51:1, a rotation speed of the motor is 2000 rpm to 3200 rpm.

The controller 110 may change a rotation speed according to an amount of laundry. The controller 110 may classify the amount of laundry into multiple levels.

As the rotation speed of the motor changes, the rotation speed of the drum changes as well. However, according to the size, diameter, or circumference of the pulley of the motor connected to the drive belt of the drum and the size, diameter, or circumference of the drum, the rotation speed of the motor may change.

In addition, according to a sensed amount of laundry, the controller 110 may change a rotation speed in a drying operation.

In the drying operation, according to an amount of laundry, the controller may perform control with a first rotation speed, which is the basic rotation speed, and, when there is a great amount of laundry, a timing of dropping the laundry may be changed due to a weight of the laundry and a drying speed is slowed down, so, in this case, the rotation speed may be set to a second rotation speed higher than the first rotation speed. The second rotation speed is higher than the first rotation speed, and falls into a range of speeds at which some of the laundry in the drum are dropped and the others rotate along with the drum.

In addition, the controller 110 varies a rotation speed or a drying time based on a dry degree of laundry, which is measured by the laundry sensing unit 132 during the drying operation. For example, in the case where an initially sensed amount of laundry is a few loads, when a dry degree satisfies a preset value after the drying operation is performed for a preset time period, a rotation speed may be changed to a third rotation speed lower than the first rotation speed. In addition, when the dry degree is smaller than a preset value after the drying operation is performed for the preset time period, the rotation speed may be changed to the second rotation speed.

For example, when an amount of laundry is a few loads or small loads, the controller 110 may set a rotation speed of the motor to 2900 rpm to 3000 rpm, and, when an amount of laundry is medium loads or large loads, the controller may set the rotation speed of the motor to 3000 rpm to 3200 rpm. In some cases, the small loads and the medium loads may be set to normal loads. In addition, according to an amount of laundry, a different rotation speed of the motor may be set.

In addition, during the drying operation, the controller 110 may change a rotation speed or a drying time according to an amount of laundry. In the case where the amount of laundry is a few loads, if a preset period of the drying time elapses, the rotation speed is changed to 2500 rpm to 2600 rpm according to a dry degree sensed by the laundry sensing unit 132.

Figure 13:
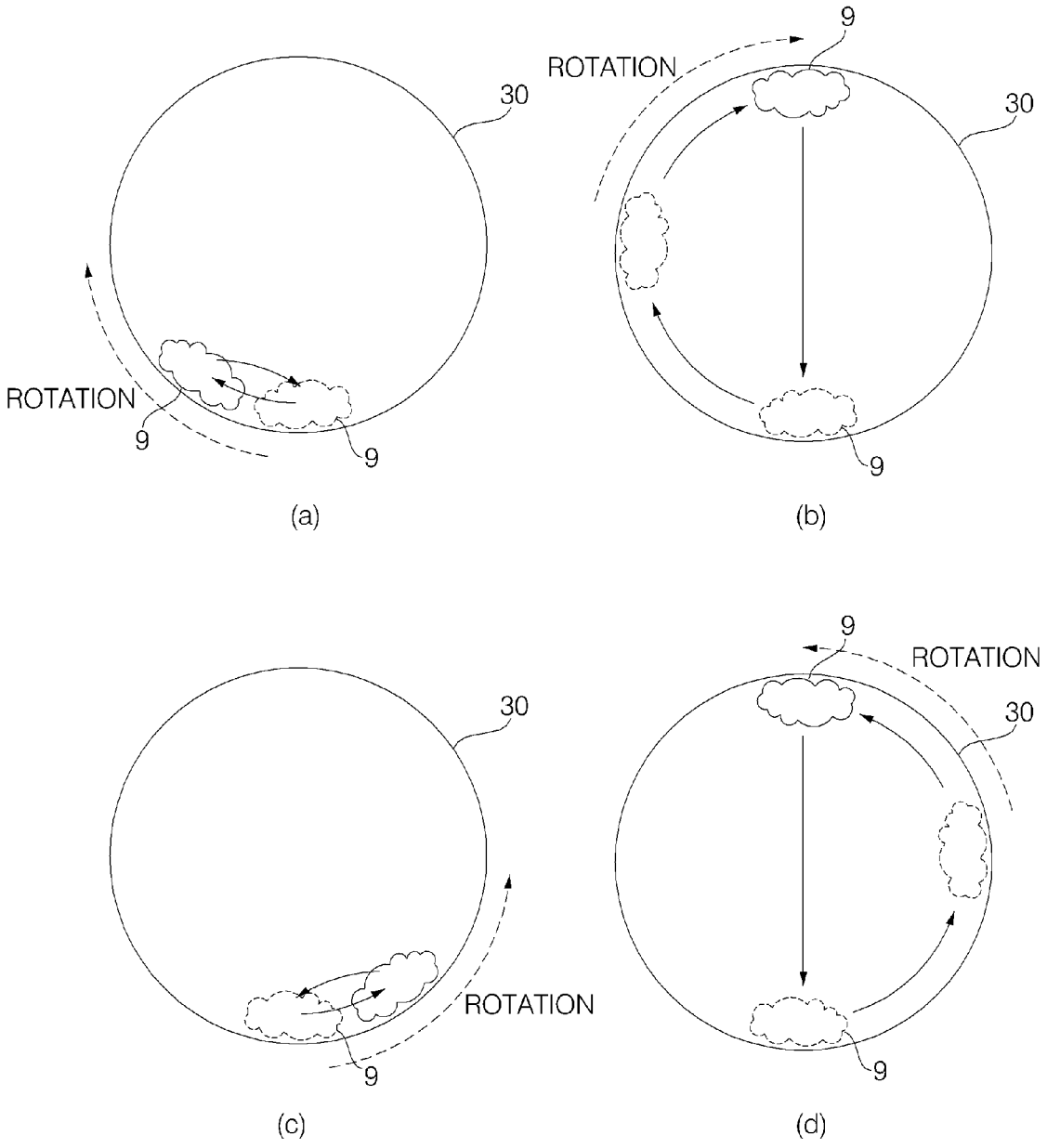
FIG. 13 is a diagram for explanation of movement of laundry in a drum in accordance with the operation pattern shown in FIG. 9.

FIG. 13 is a diagram for explanation of movement of laundry in a drum in accordance with the operation pattern shown in FIG. 9.

As illustrated in FIG. 13, at a time of sensing the amount (quantity) of laundry, the drum 30 repeatedly rotates forward or backward, and the controller 110 senses an amount of laundry based on a current value sensed by the current sensing unit 135.

While driving the drum 30 to accelerate a rotation speed of the drum 30, maintaining the rotation speed, and stopping the drum, the controller 110 measures current values for the acceleration stage and the maintaining stage, thereby sensing the amount of laundry.

In the case of performing the operation pattern once by rotating forward, the laundry in the drum is in a state of rotating and rolling during a period in which the rotation speed of the drum is accelerated.

As the rotation speed increases, the laundry in the drum is lifted by the drum and dropped, as shown in (b) and (d) of FIG. 13.

When the laundry is dropped, movement of the drum may occur, but this normally happens in the drying operation, so the controller 110 may measure the amount of laundry in a state in which the laundry is dropped.

Figure 14:
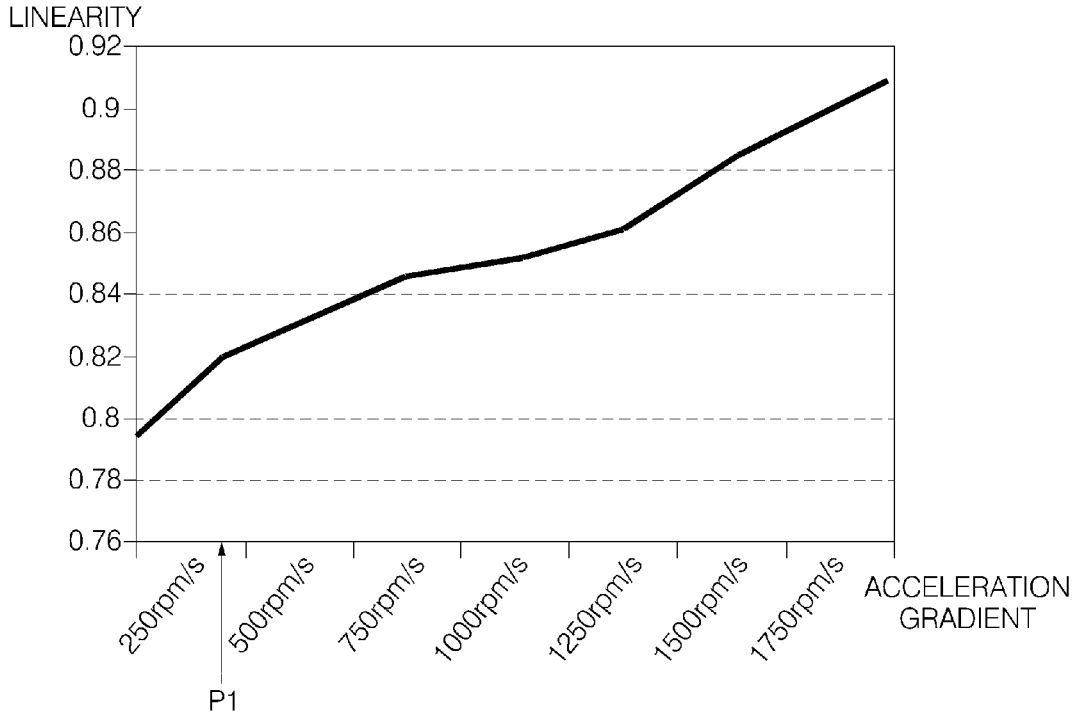
FIG. 14 is a diagram for explanation of sensed properties in accordance with the amount of laundry in a dryer according to an embodiment of the present disclosure.
Figure 14:
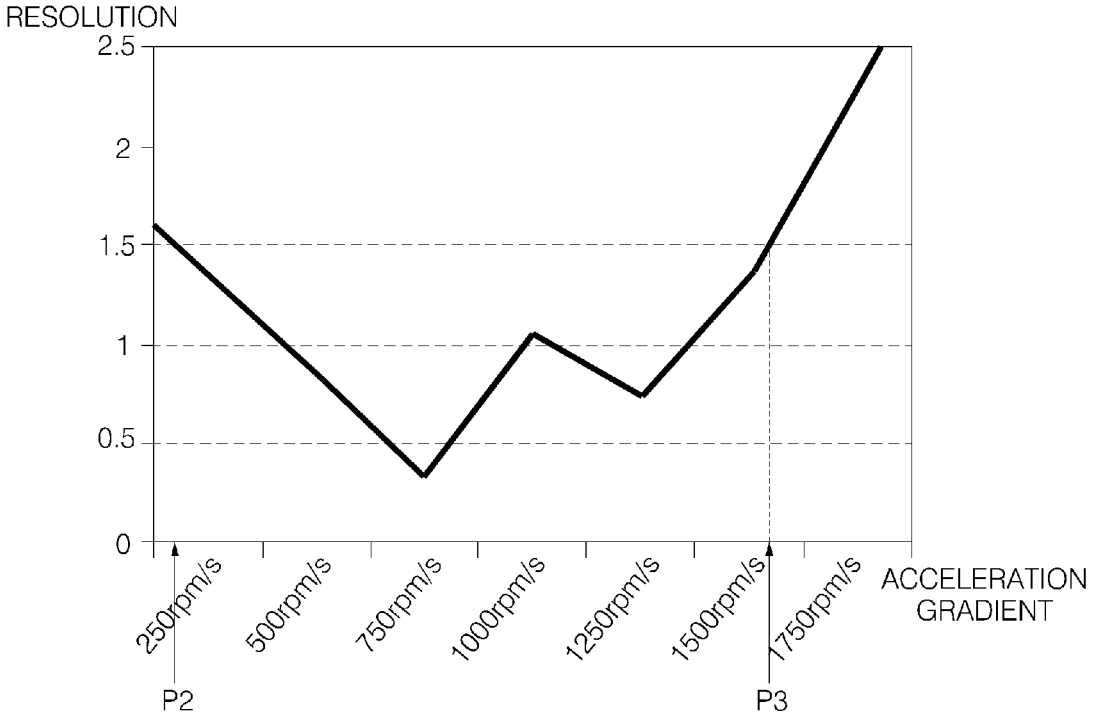

FIG. 14 is a diagram for explanation of sensed properties in accordance with the amount of laundry in a dryer according to an embodiment of the present disclosure.

When measuring the amount of laundry, the dryer 1 repeatedly perform an operation pattern, including increasing a rotation speed of the drum, maintaining the increased rotation speed, and then stopping the rotation, a predetermined number of time. The dryer 1 divides the operation pattern into an acceleration stage in which the drum 20 accelerates the rotation speed thereof to a target rotation speed, a maintaining stage, and a stopping stage, and then measures current values for the respective periods. According to a degree of increase in the rotation speed in the acceleration stage, that is, an acceleration gradient, a deviation in measurements of laundry occurs.

As illustrated in FIG. 14, when it comes to measuring the amount of laundry, the controller 110 may calculate the amount of laundry by considering a linearity and a resolution calculated according to an acceleration gradient in relation to an increase of the amount of laundry.

As illustrated in (a) of FIG. 14, as the acceleration gradient increases, the linearity increases. However, when the acceleration gradient increases, a slip between the drum 30 and the drive belt may occur, and therefore, it is preferable to accelerate rotation of the drum at a predetermined acceleration gradient or less.

When it comes to sensing an amount of laundry, a linearity refers to a degree of discrimination between calculated values according to the amount of laundry, and indicates a degree of increase in calculated values in proportion to increase in the amount of laundry. For example, the linearity indicates a degree of clearness in discrimination between a measurement obtained in response to 1 kg laundry and a measurement obtained in response to 2 kg laundry.

When the linearity is equal to or greater than 0.8, it is possible to discriminate an amount of laundry, and thus, in order to determine the amount of laundry, it is preferable to accelerate a rotation speed of the drum at an acceleration gradient with the linearity equal to or greater than 0.8. In order to more clearly determine the amount of laundry, it is preferable to control a rotation speed of the drum at an acceleration gradient equal to or greater than 0.82.

Figure 16:
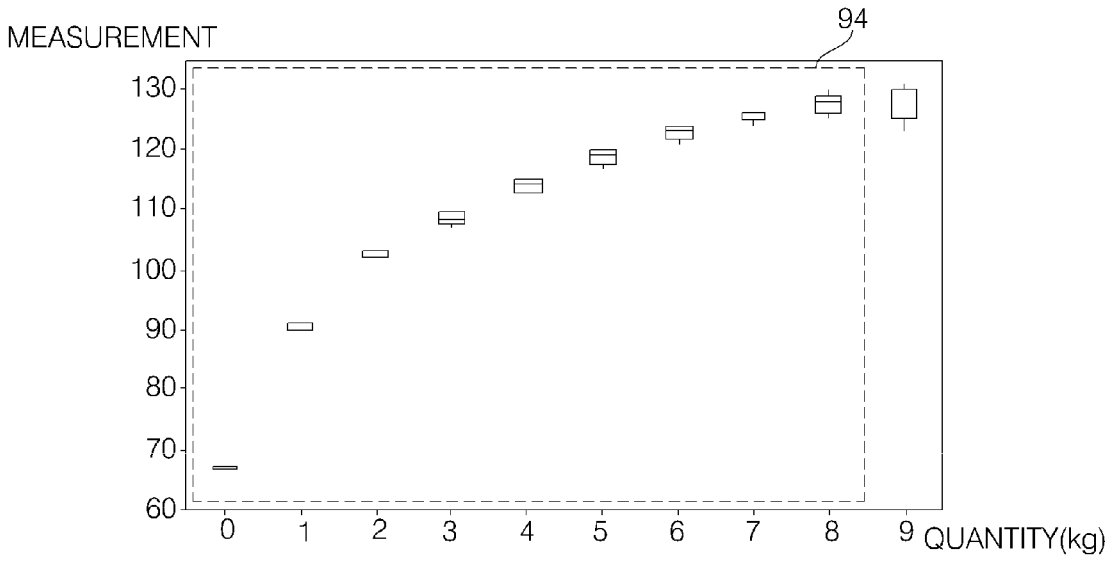
Figure 16:
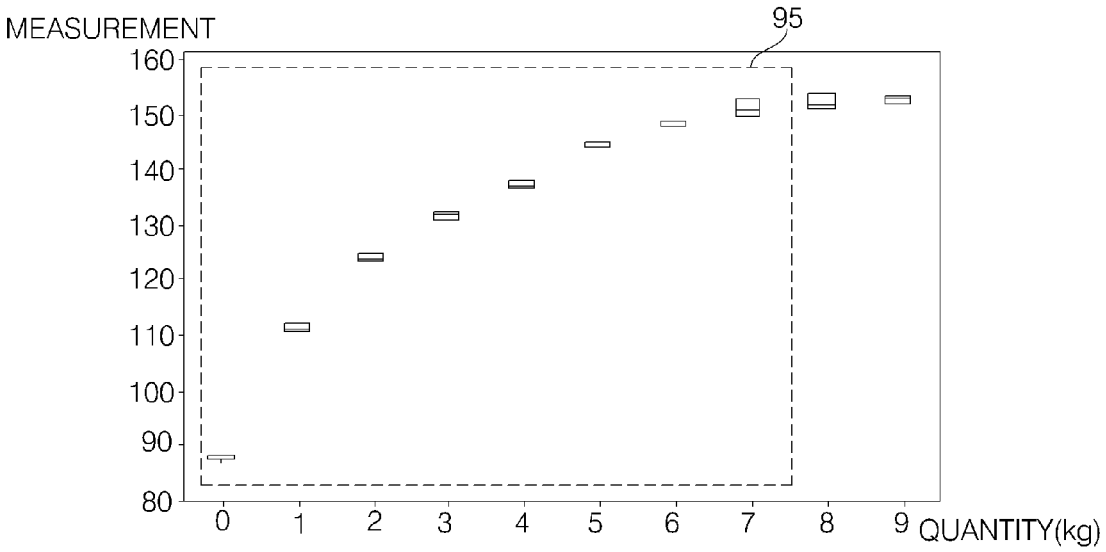

As shown in FIG. 16 which will be described later, it is preferable that difference between calculated values is found big enough to discriminate according to an increase in the amount of laundry.

If the linearity is equal to or greater than 0.8, the acceleration gradient is equal to or greater than about 300 rpm/s.

If the linearity is equal to or greater than 0.82, the acceleration gradient is equal to or greater than about 450 rpm/s (p1).

As illustrated in (b) of FIG. 14, as an acceleration gradient is increased, a resolution is varied. The resolution refers to a deviation in measurements with respect to an amount (weight) of same laundry, and the resolution is a range of measurements according to an amount of laundry, as shown in FIG. 16 which will be described later. If a range of measurements are wide with respect to the amount of the same laundry, there may be overlapping sections and thus it would be difficult to discriminate an amount of laundry. On the other hand, if a range of measurements is narrow with respect to the amount of the same laundry (if a deviation is small), it is easy to discriminate an amount of laundry in each section.

Thus, when it comes to sensing an amount of laundry, a resolution is preferably equal to or smaller than 1.5.

If the resolution is equal to or smaller than 1.5, an acceleration gradient for accelerating a rotation speed of the drum is 300 rpm/s (P2) to 1700 rpm/s (P3).

In the case where the linearity and the resolution are both considered, an acceleration gradient in an acceleration stage is preferably 300 rpm/s (P2) to 1700 rpm/s (P3) when it comes to determining the amount of laundry. With the linearity of 0.82 or greater, the acceleration gradient is preferably 500 rpm/s to 1700 rpms (P3).

If an acceleration gradient increases, a linearity increases but a resolution decreases (a value thereof increases), and thus, the acceleration gradient is preferably set to 300 rpm/s (P2) to 1700 rpm/s (P3).

According to a resolution graph, it is found that good performance is achieved at the acceleration gradient of 500 rpm/s to 100 rpm/s and 1250 rpm/s to 1500 rpm/s. In addition, in the case where the acceleration gradient is 100 rpm/s to 1250 rpm/s, performance degradation may occur due to idling of the motor, but this degradation is merely a change in performance still falling within a range in which linearity and resolution satisfy set values, and therefore, such an acceleration gradient is applicable. The linearity and the resolution may vary depending on a structure of connection between the drum and the motor, and characteristics of the motor.

Figure 15:
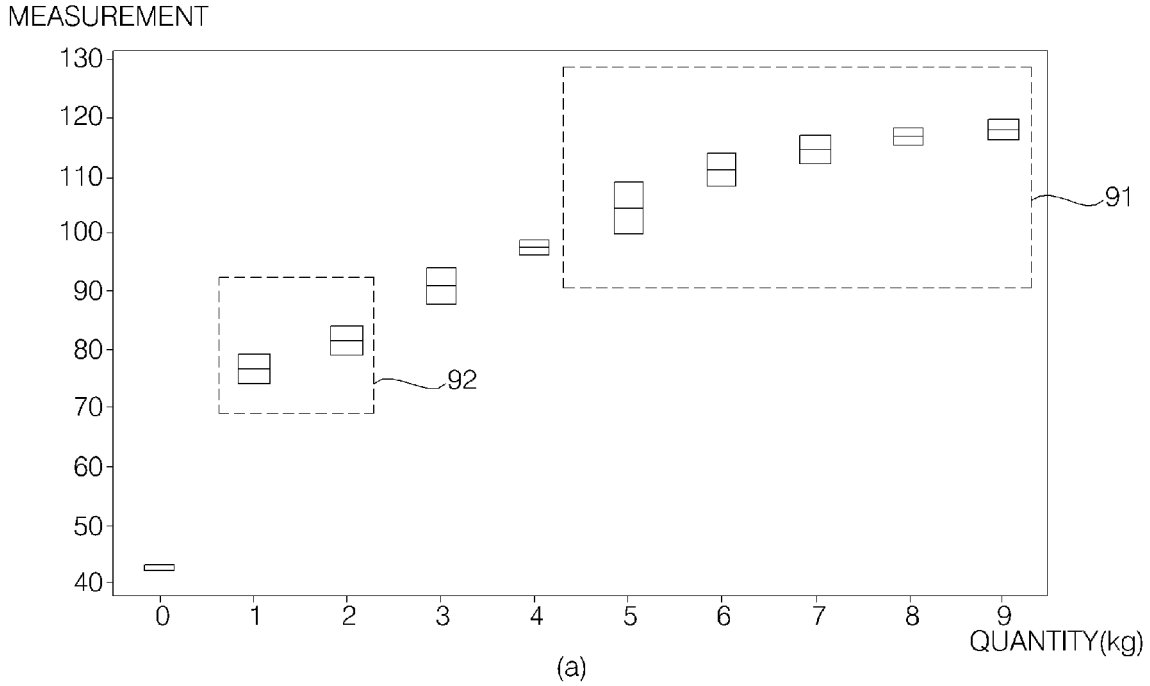
FIGS. 15 to 17 are graphs illustrating results of sensing an amount of laundry in a dryer according to an embodiment of the present disclosure.
Figure 15:
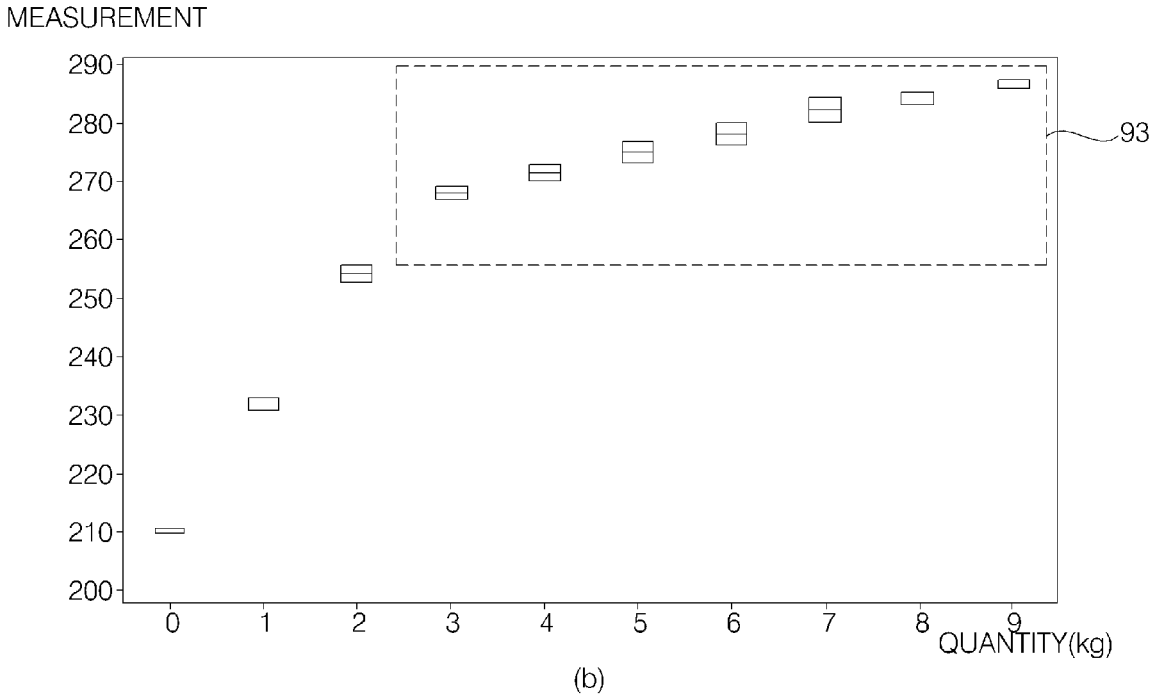
Figure 17:
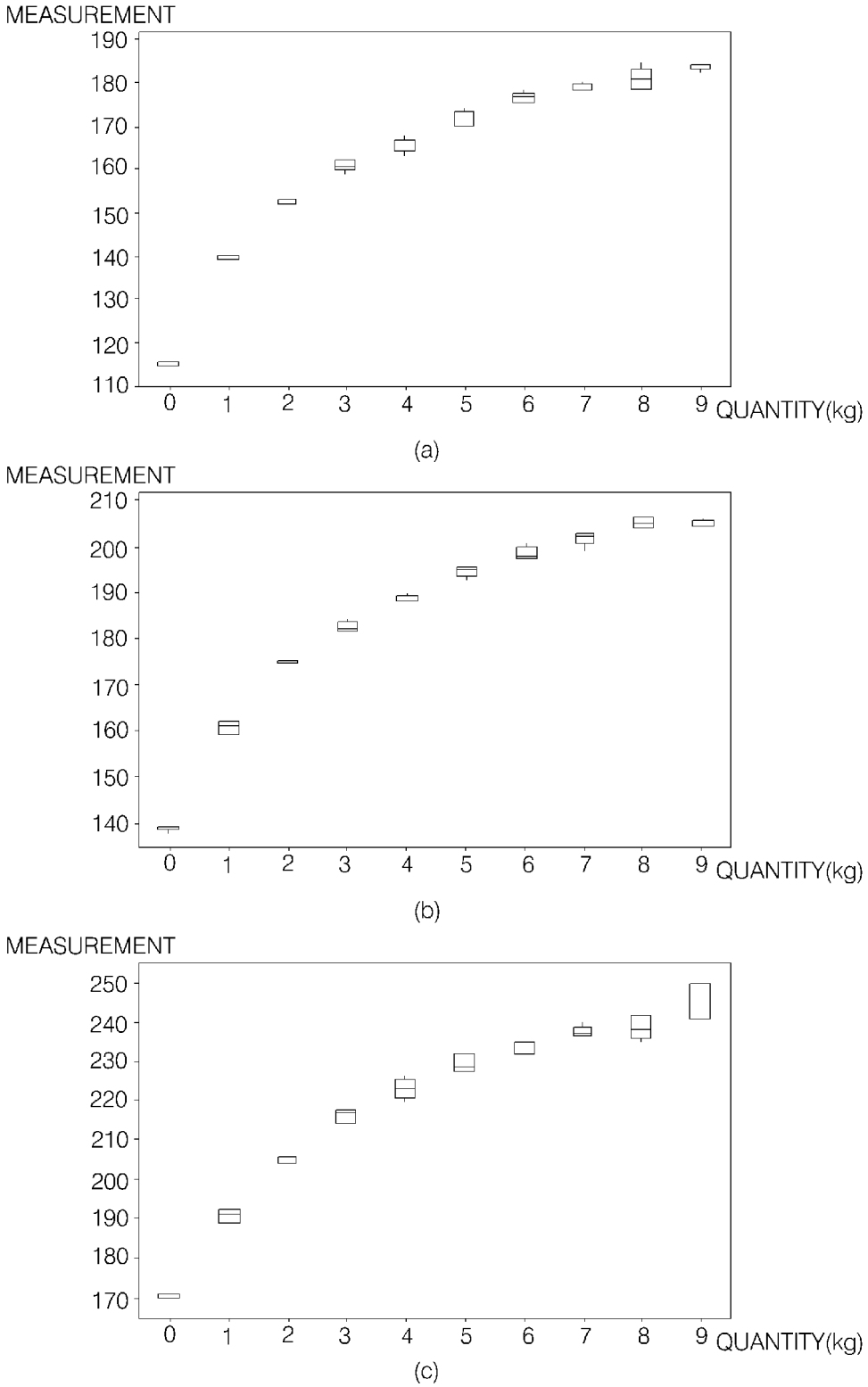

FIGS. 15 to 17 are graphs illustrating results of sensing an amount of laundry in a dryer according to an embodiment of the present disclosure.

Results on calculation of an amount of laundry according to an acceleration gradient is as follows. The drawings show measurements obtained based on the same laundry having moisture content of 66.6%.

An amount of laundry measured at an acceleration gradient of 250 rpm/s is shown in (a) of FIG. 15, and the amount of laundry measured at an acceleration gradient of 1750 rpm/s is shown in (b) of FIG. 15.

As illustrated in (a), when the acceleration gradient is 250 rpm/s, a linearity is low because of small difference between measurements in sections according to an amount of laundry, and a resolution is low because of a wide range (a great deviation) of measurements with respect to an amount of the same laundry. For example, weight measurements are redundant in sections corresponding to 1 kg to 2 kg (92) and sections corresponding to 5 kg or more (91), and thus, it is difficult to discriminate an amount of laundry.

As illustrated in (b) of FIG. 15, when the acceleration gradient is 1750 rpm/s, a good linearity is achieved with respect to a small amount of laundry, but the linearity and the resolution are both low in sections corresponding to 3 kg or more (93).

An amount of laundry measured at an acceleration gradient of 500 rpm/s is shown in (a) of FIG. 16, and an amount of laundry measured at an acceleration gradient of 750 rpm/s is shown in (b) of FIG. 16. (a) of FIG. 17 an amount of laundry measured at an acceleration gradient of 1000 rpm/s is shown in (a) of FIG. 17, an amount of laundry measured at an acceleration gradient of 1250 rpm/s is shown in (b) of FIG. 17, and an amount of laundry measured at acceleration gradient of 1500 rpm/s is shown in (c) of FIG. 17.

As illustrated in (a) and (b) of FIG. 16 and (a) to (c) of FIG. 17, a linearity and a resolution satisfy ranges respectively set therefor when the acceleration gradient are 500 rpm/s, 750 rpm/s, 1000 rpm/s, 1250 rpm/s, and 1500 rpm/s.

For example, when the acceleration gradient is 750 rpm/s, the linearity is excellent because of enough difference between measurements according to an amount of laundry, and a resolution is excellent because of a narrow range of measurements with respect to the amount of the same laundry.

Therefore, when measuring an amount of laundry, the controller 110 may set an acceleration gradient in the acceleration stage to be fall within a range of 500 rpm/s to 1500 rpm/s. In particular, the controller 110 may control the acceleration stage with the acceleration gradient of 750 rpm/s.

Figure 18:
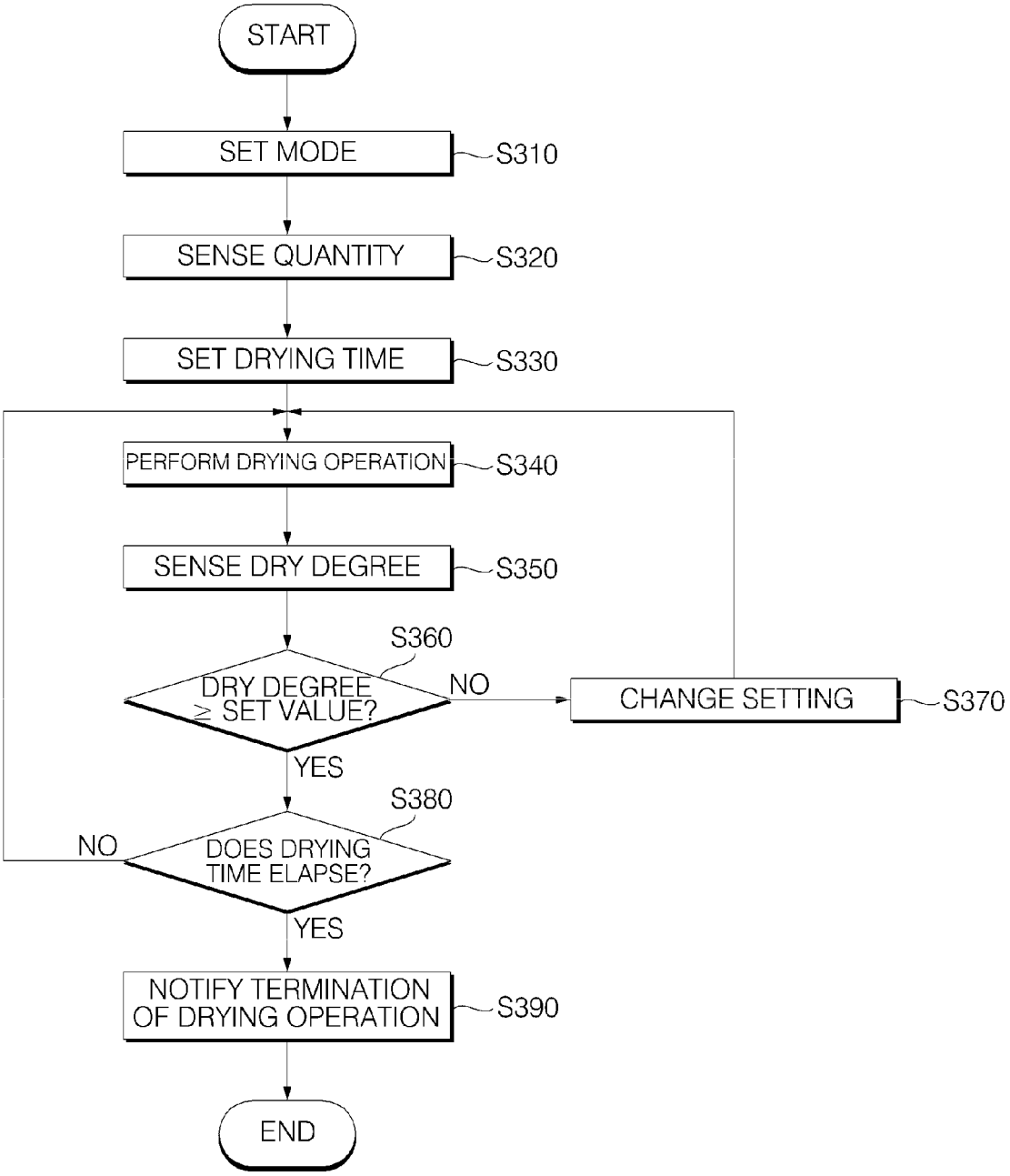
FIG. 18 is a flowchart illustrating a method of controlling a dryer according to an embodiment of the present disclosure.

FIG. 18 is a flowchart illustrating a method of controlling a dryer according to an embodiment of the present disclosure.

As illustrated in FIG. 18, the dryer 1 operates such that laundry is loaded into the drum 30 and a mode according to a drying operation is set by the operator 170 (S310). For example, a mode is set according to a type of the laundry, especially according to a material of the laundry, such as silk, cotton, or the like.

The controller 110 senses the amount (quantity) of the laundry by controlling the driver 160 (S320). The driver 160 rotates the drum in accordance with a control command, and, once the drum rotates in accordance with a pattern, the current sensing unit 135 measures a current value of the motor.

The controller 110 may store a current value, sensed by the current sensing unit, for each of the acceleration and the maintaining stage on the basis of each number of times, that is, on a per round-of-pattern basis.

The controller 110 sets a drying time according to the amount (quantity) of laundry (S330). The set drying time is displayed on a display of the output unit 175.

The controller 110 determines an amount of laundry to be one of multiple levels, and sets a preset drying time according to the determined amount of the laundry.

The driver 160 performs the drying operation such that the motor is driven in accordance with a control command from the controller, thereby rotating the drum and operating the blow fan (S340).

During the drying operation, the drum lifts the laundry and lets the laundry fall repeatedly. During the rotation of the drum, air circulated by the blow fan 64 is heated up by the condenser 52 or the heater 69 of the heat pump module 120 and then supplied to the drum, and moisture evaporated from the laundry is contained in the air and flows to the evaporator through the circulation flow path by the blow fan. As a refrigerant and air having high moisture content are thermally exchanged in the evaporator, the air is cooled down and the moisture contained in the air is condensed, thereby generating condensate. Humidified air flows to the condenser, and is heated up and then supplied back to the drum.

The laundry sensing unit 132 disposed at a lower end in the entry hole senses a dry degree of laundry in response to a current flowing at a time when two electrodes 18 contact the laundry, and inputs a predetermined signal to the controller (S350).

The controller determines whether the dry degree of the laundry is equal to or greater than a set value, that is whether the amount of moisture contained in the laundry is equal to or greater than a predetermined value (S360).

At a time when a preset period of the drying time has elapsed, if the dry degree is smaller than the set value, the controller 110 changes an operation setting (S370) and keeps performing the drying operation (S340). The controller 110 may extend the drying time or change a rotation speed of the drum.

At a time when the preset period of the drying time has elapsed, if the dry degree is equal to or greater than the set value, the controller 110 maintains the current operation state.

If the drying time has elapsed (S380), the controller 110 outputs a drying operation termination notification through the output unit 175 (S390). The controller 110 outputs the termination notification through a display and output notification sound through a speaker according to termination of the drying operation. In some cases, the controller 110 may transmit a notification message to a connected terminal.

Accordingly, the present disclosure determines an amount of laundry by measuring currents in an acceleration stage in which a rotation speed of motor increases during rotation of the drum and in a maintaining stage in which the rotation speed of the motor is maintained, thereby enabled to minimize influence of friction and more accurately determine the amount of laundry using inertia properties.

In addition, the present disclosure drives the motor in a manner in which the drum and the blow fan operate in conjunction with each other to adjust a speed of air that circulates while passing through laundry, thereby enabled to efficiently dry the laundry.

Although all components of the embodiments are described as operating in combination with each other as one body, the present disclosure is not necessarily limited to the embodiments described above. According to embodiments, one or more of all components may be selectively combined without departing from the spirit of the present disclosure.

The foregoing description is merely an illustrative example of the technical idea of the present disclosure, and any person skilled in the art may make various modification and variations without departing from the spirit of the present disclosure.

What is claimed is:

1. A dryer comprising:

a drum configured to accommodate laundry;

a motor connected to the drum by a drive belt and configured to rotate the drum;

a blow fan configured to circulate air through the drum in response to driving of the motor;

a current sensing unit configured to measure a current value of the motor; and a controller that is configured to apply operation power to the motor to thereby operate the motor or stop the motor, that is configured to control a rotation speed of the motor, and that is configured to sense an amount of laundry based on the current value sensed by the current sensing unit during a rotation of the drum, wherein the controller is further configured to, for sensing the amount of laundry, control the motor to thereby control a rotation speed of the drum based on (i) an acceleration stage in which the rotation speed of the drum is increased and (ii) a maintaining stage in which the rotation speed of the drum is maintained, and wherein the controller is further configured to, in the acceleration stage, increase the rotation speed of the drum based on an acceleration gradient of the motor that is set in a range from 500 rpm/s to 1500 rpm/s.

2. The dryer of claim 1, wherein the controller is further configured to increase the rotation speed of the drum at an acceleration gradient of the drum corresponding to the acceleration gradient of the motor that is set to 750 rpm/s in the acceleration stage.

3. The dryer of claim 1, wherein the controller is further configured to set a duration of the acceleration stage to be greater than a duration of the maintaining stage to limit a slip between the drive belt and the drum based on an increase of the rotation speed of the drum in the acceleration stage.

4. The dryer of claim 1, wherein the controller is further configured to control the rotation speed of the drum at the acceleration gradient of the motor that is set according to a linearity value corresponding to a change of measurements of the amount of laundry with respect to an increase of the amount of laundry, and a resolution value corresponding to a variation range of measurements of the amount of laundry.

5. The dryer of claim 4, wherein the controller is further configured to control the rotation speed of the drum at the acceleration gradient of the motor that is set according to the resolution value less than or equal to 1.5.

6. The dryer of claim 4, wherein the controller is further configured to control the rotation speed of the drum at the acceleration gradient of the motor that is set according to the linearity value greater than or equal to 0.8.

7. The dryer of claim 1, wherein the controller is further configured to, in the acceleration stage, control the rotation speed of the drum at an acceleration gradient of the drum corresponding to an acceleration gradient of the motor that is set in a first range from 500 rpm/s to 1000 rpm/s or in a second range from 1250 rpm/s or 1500 rpm/s.

8. The dryer of claim 1, wherein the controller is further configured to control the motor to rotate the drum at the rotation speed of the drum in a range from 39 rpm to 63 rpm at an end time point of the acceleration stage.

9. The dryer of claim 1, wherein the controller is further configured to determine the amount of laundry based on repeating the acceleration stage and the maintaining stage for a predetermined number of times.

10. The dryer of claim 9, wherein the controller is further configured to control the motor to change a rotation direction of the drum after the maintaining stage.

11. The dryer of claim 9, wherein the controller is further configured to control the motor to rotate the drum five to six times based on an operation pattern comprising the acceleration stage and the maintaining stage.

12. The dryer of claim 1, wherein the controller is further configured to control the drum in a stopping stage until the drum stops rotating after the maintaining stage.

13. The dryer of claim 1, wherein the controller is further configured to determine the amount of laundry based on excluding a friction component from a plurality of force components acting on the drum during rotation of the drum, the friction component comprising friction force between the drive belt and the drum, and wherein the controller is further configured to exclude the friction component based on a difference of current values of the motor sensed in the acceleration stage and the maintaining stage.

14. The dryer of claim 1, wherein the controller is further configured to determine the amount of laundry based on a force of gravity acting on the laundry in the maintaining stage and a force of inertia acting on the laundry in the acceleration stage.

15. A method of controlling a dryer, comprising:

receiving laundry at a drum of the dryer;

rotating the drum by driving a motor of the dryer based on receiving the laundry;

increasing a rotation speed of the drum in an acceleration stage;

after the acceleration stage, maintaining the rotation speed of the drum in a maintaining stage;

determining an amount of laundry by sensing current values of the motor during rotation of the drum; and performing a drying operation based on the amount of laundry, wherein increasing the rotation speed of the drum in the acceleration stage comprises increasing the rotation speed of the drum based on an acceleration gradient of the motor that is set in a range from 500 rpm/s to 1500 rpm/s.

16. The method of claim 15, wherein increasing the rotation speed of the drum further comprises:

controlling an acceleration of the drum in the acceleration stage according to a linearity value corresponding to a change of measurements of the amount of laundry with respect to an increase of the amount of laundry, and a resolution value corresponding to a variation range of measurements of the amount of laundry, and wherein the resolution value and the linearity value are calculated based on the current values corresponding to the amount of laundry.

17. The method of claim 16, wherein increasing the rotation speed of the drum further comprises:

controlling the rotation speed of the drum based on the acceleration gradient of the motor that is calculated according to the resolution value less than or equal to 1.5 and the linearity value greater than or equal to 0.8.

18. The method of claim 15, wherein increasing the rotation speed of the drum further comprises:

setting a duration of the acceleration stage to be greater than a duration of the maintaining stage to avoid a slip between a drive belt and the drum based on an increase of the rotation speed of the drum in the acceleration stage to a first rotation speed for the maintaining stage.

19. The method of claim 15, wherein increasing the rotation speed of the drum further comprises increasing the rotation speed of the drum at an acceleration gradient of the drum corresponding to the acceleration gradient of the motor that is set to 750 rpm/s in the acceleration stage.

20. The method of claim 15, further comprising:

changing a rotation direction of the drum after the maintaining stage; and repeating the acceleration stage and the maintaining stage for a predetermined number of times.

* * * * *